US008985371B2

(12) United States Patent
Zabaleta et al.

(10) Patent No.: US 8,985,371 B2
(45) Date of Patent: Mar. 24, 2015

(54) RESEALABLE BEVERAGE CONTAINERS AND METHODS OF MAKING SAME

(71) Applicants: Daniel A. Zabaleta, Cooper City, FL (US); Sam Hackett, Ft. Lauderdale, FL (US)

(72) Inventors: Daniel A. Zabaleta, Cooper City, FL (US); Sam Hackett, Ft. Lauderdale, FL (US)

( * ) Notice: Subject to any disclaimer, the term of this patent is extended or adjusted under 35 U.S.C. 154(b) by 27 days.

(21) Appl. No.: 13/787,012

(22) Filed: Mar. 6, 2013

(65) Prior Publication Data

US 2014/0042164 A1 Feb. 13, 2014

Related U.S. Application Data

(63) Continuation-in-part of application No. 13/572,404, filed on Aug. 10, 2012, now Pat. No. 8,844,761.

(51) Int. Cl.
*B65D 51/22* (2006.01)
*B65D 41/36* (2006.01)
(Continued)

(52) U.S. Cl.
CPC ..... *B65D 41/32* (2013.01); *B65D 17/166* (2013.01); *B65D 41/365* (2013.01); *B65D 2517/002* (2013.01); *B65D 2517/0043* (2013.01); *B65D 2517/0062* (2013.01); *B65D 2517/0082* (2013.01); *B65D 2517/5091* (2013.01); *Y10S 220/906* (2013.01)
USPC ..... 220/254.8; 220/906; 220/293; 220/278; 220/284; 220/298

(58) Field of Classification Search
CPC .. B65D 2205/00; B65D 47/36; B65D 51/007; B65D 51/1672; B65D 51/1677; B65D 51/22; B65D 51/221; B65D 51/222; B65D 2517/0097; B65D 2517/0091; B65D 2543/00898
USPC ..... 220/906, 254.8, 258.1, 258.3–258.5, 220/274, 275, 277, 278, 281, 284, 212.5, 220/293, 298; 215/295–299, 301, 305; 222/81, 83
See application file for complete search history.

(56) References Cited

U.S. PATENT DOCUMENTS

| | | | |
|---|---|---|---|
| 2,303,205 | A | 11/1942 | Frankenberg |
| 3,638,597 | A | 2/1972 | Brown |
| 3,726,432 | A | 4/1973 | Gentile |

(Continued)

FOREIGN PATENT DOCUMENTS

| | | |
|---|---|---|
| EP | 0414249 A2 | 2/1991 |
| EP | 2212215 B1 | 2/2012 |

(Continued)

*Primary Examiner* — Fenn Mathew
*Assistant Examiner* — James N Smalley
(74) *Attorney, Agent, or Firm* — Allen D. Hertz, P.A.; Allen D. Hertz

(57) ABSTRACT

A resealable beverage container includes a cap that moves between storage, opening, removal and resealing positions. Ramps are used to enhance an opening force generally delivered by the engagement between the socket and the cap. An elastomeric sealing element is disposed between the cap and the socket so that when the cap is in the fully seated or sealed position, an airtight or at least substantially airtight seal is created to prevent the contents of the container from leaking out. Further enhancements are disclosed that include a score line structure in the socket bottom wall that facilitates a predictable and repeatable opening of the container along the score line. A grip is provided that includes a gap or space into which a coin or other implement can be inserted to allow the consumer a better grip to provide adequate opening force.

34 Claims, 35 Drawing Sheets

(51) Int. Cl.
*B65D 41/32* (2006.01)
*B65D 17/00* (2006.01)

(56) References Cited

U.S. PATENT DOCUMENTS

| | | | | | |
|---|---|---|---|---|---|
| 3,877,604 | A | * | 4/1975 | Brown | 220/267 |
| 3,924,777 | A | | 12/1975 | Peyser | |
| 3,938,693 | A | * | 2/1976 | Patel et al. | 222/81 |
| 4,172,532 | A | * | 10/1979 | Palsson | 215/215 |
| 4,685,849 | A | | 8/1987 | LaBarge et al. | |
| 4,705,186 | A | | 11/1987 | Barrash | |
| 4,723,687 | A | * | 2/1988 | Kutterer | 222/83 |
| RE32,927 | E | | 5/1989 | Taylor | |
| 4,865,215 | A | * | 9/1989 | Wells | 220/269 |
| 5,248,053 | A | | 9/1993 | Lundgren | |
| 5,292,025 | A | | 3/1994 | Dubreul | |
| 5,443,175 | A | * | 8/1995 | Kelly et al. | 220/298 |
| 5,622,208 | A | | 4/1997 | Vinson | |
| 5,692,633 | A | | 12/1997 | Gordon | |
| 5,711,447 | A | | 1/1998 | Plester | |
| 5,779,086 | A | | 7/1998 | Barrash | |
| 5,785,198 | A | | 7/1998 | Credle | |
| 5,799,775 | A | * | 9/1998 | Spring | 206/222 |
| 5,816,428 | A | | 10/1998 | Plester | |
| 5,947,318 | A | * | 9/1999 | Palm | 220/278 |
| 6,082,944 | A | | 7/2000 | Bachmann | |
| 6,206,222 | B1 | * | 3/2001 | Cudzik | 220/258.3 |
| 6,216,904 | B1 | | 4/2001 | Cagan | |
| 6,234,338 | B1 | | 5/2001 | Searle | |
| 6,332,551 | B1 | | 12/2001 | Copeland | |
| 6,450,358 | B1 | | 9/2002 | Berro | |
| 6,626,314 | B1 | | 9/2003 | McHenry et al. | |
| 6,651,833 | B2 | | 11/2003 | Sciarini | |
| 6,739,471 | B2 | | 5/2004 | Goetz et al. | |
| 6,910,598 | B2 | | 6/2005 | Gotz et al. | |
| D559,680 | S | | 1/2008 | Jacober et al. | |
| 7,823,740 | B2 | | 11/2010 | Perra | |
| 7,841,222 | B2 | | 11/2010 | Cook et al. | |
| 7,891,517 | B2 | | 2/2011 | Simmons | |
| 7,918,359 | B2 | | 4/2011 | Paris et al. | |
| 8,215,513 | B1 | | 7/2012 | Grissom | |
| 8,336,728 | B2 | | 12/2012 | Forrest et al. | |
| 8,556,106 | B1 | * | 10/2013 | Bayat et al. | 220/294 |
| 2002/0030053 | A1 | | 3/2002 | Copeland | |
| 2003/0213709 | A1 | * | 11/2003 | Gibler et al. | 206/219 |
| 2005/0029264 | A1 | | 2/2005 | Werth | |
| 2005/0115969 | A1 | | 6/2005 | Mizuma | |
| 2005/0150889 | A1 | | 7/2005 | Perra | |
| 2005/0279746 | A1 | | 12/2005 | Hsu | |
| 2008/0053997 | A1 | | 3/2008 | Perra | |
| 2008/0110922 | A1 | | 5/2008 | Sines | |
| 2009/0026201 | A1 | | 1/2009 | Hall et al. | |
| 2010/0126992 | A1 | | 5/2010 | Phillips | |
| 2010/0133275 | A1 | | 6/2010 | Phillips | |
| 2010/0294768 | A1 | | 11/2010 | Ramsey et al. | |
| 2010/0320207 | A1 | * | 12/2010 | Sjogren et al. | 220/270 |
| 2011/0036839 | A1 | | 2/2011 | Gardner | |
| 2011/0062106 | A1 | | 3/2011 | Akveld | |
| 2011/0100946 | A1 | | 5/2011 | Perra | |
| 2012/0037631 | A1 | | 2/2012 | Weist | |
| 2012/0273490 | A1 | | 11/2012 | Jensen | |
| 2013/0082055 | A1 | | 4/2013 | Ramsey et al. | |
| 2013/0200034 | A1 | | 8/2013 | Kaanta | |

FOREIGN PATENT DOCUMENTS

| | | | |
|---|---|---|---|
| WO | WO 2011025327 | A2 | 3/2011 |
| WO | WO 2011124552 | A1 | 10/2011 |

* cited by examiner

RESEALABLE BEVERAGE CONTAINERS AND METHODS OF MAKING SAME

CROSS-REFERENCE TO RELATED APPLICATIONS

This application is a Continuation-In-Part, U.S. patent application Ser. No. 13/572,404, entitled "Resealable Beverage Containers and Methods of Making Same, filed Aug. 10, 2012, under 35 USC 120, which has subsequently issued as U.S. Pat. No. 8,844,761 on Sep. 30, 2014, and is incorporated in its entirety.

BACKGROUND OF THE INVENTION

1. Field of the Invention

The present invention relates to resealable beverage containers and methods of making same. In particular, and according to one aspect of the invention, a beverage container such as an aluminum can is provided with a cap that is twisted by the consumer to open the can. The twist or rotational movement of the cap is converted into linear motion by a cam mechanism to drive the cap into opening action, whereby a frangible sealing tab is pushed into the can. Once the can is opened, the cap can be reverse-twisted to remove it from the opening, and then after drinking, the consumer can twist the cap back into a sealing position within the opening.

2. Description of the Related Art

The beverage and can industries have long sought to create a can that is both economical to produce and convenient for use by consumers. In the past, beverage cans were provided with a "pull tab" which the consumer would grab by a ring, and pull until the tab was removed from the can. This created a problem in that the tab became disposable waste for which the consumer was responsible to ensure proper disposal. Often the consumer failed to properly dispose of the tab, thereby creating not only litter, but also a safety issue, in that the tabs could be swallowed by small children. Moreover, the edges of the pull tab were sharp enough that they could, if mishandled, cut the fingers or hands of the consumer or anyone else who handled a loose pull tab. As a result of these problems, the industry moved in the direction of a tab that stayed on the can after opening, thereby preventing both litter and any sharp edges from coming into contact with consumers.

The present state of the art is to have a "stay on" tab that is attached to the can lid by a rivet formed in the can lid next to the opening. The opening is formed by a score line, or frangible "kiss cut" which breaks when the tab is pulled up by the consumer. The score line, when broken, produces a hinged flap that stays connected to the can lid, but inside the can.

Beverage cans with stay on tabs suffer from at least the following deficiencies. First, they are not resealable, so that once the consumer opens the beverage, the contents are subject to loss of carbonation, and the influx of foreign material due to the contents being open to the surrounding environment. Secondly, in order to form the rivet which is used to secure the stay on tab to the beverage lid, the lid needs to be made of a different material, typically an aluminum alloy that is stronger than the aluminum alloy used to make the sides and bottom of the can. Further, the tab itself is typically made of a different alloy than the sides and lid, reflecting the need for a still stronger, typically heavier material As a result, recycling of the aluminum beverage can is problematic because the different materials need to be separated. The use of three different materials also tends to add weight, and expense, to the finished container.

A need exists for improved beverage containers that are resealable, cost effective to produce, and "green" in terms of avoiding waste and facilitating the recycling of aluminum cans. Concurrently, a need exists for improved methods for manufacturing beverage containers that result in faster production time, lower production costs, and improved products.

SUMMARY OF THE INVENTION

A beverage can has a sidewall and integrally formed bottom. A top lid includes a socket integrally formed therein which includes a substantially cylindrical sidewall and a bottom wall. A score line formed in the bottom wall defines tab which forms an opening into the can when the score line is broken. A cap is fitted in the socket and has a sidewall which is formed with cam surfaces. The cam surfaces cooperate with detents formed in the cylindrical sidewall of the socket, so that when the cap is twisted or rotated through a sufficient number of radians, or angle of motion, the cam surfaces translate rotational motion into linear motion, driving the cap downwardly into the socket. As the cap moves downwardly, a protrusion formed on the lower surface of the cap impinges on the periphery of the score line, thereby pushing the tab into the can.

Once opened, the cap can be discarded if the entire contents of the can are consumed. Alternatively, the cap can be re-fitted into the socket, so that the cam surfaces engage the detents, and rotated to achieve a sealing position, whereby the contents of the can are protected from the ambient atmosphere. This will result in the prevention of spillage, the loss of carbonation, and the prevention of foreign objects from entering the can.

Preferably, the beverage container is a "can," but the same principals described above could be used for other types of beverage containers, including bottles made of various materials, including plastic, paper, metal (such as aluminum), cartons, cups, glasses, etc. In one particularly preferred embodiment, the beverage container is an aluminum can, and lid is made of the same aluminum alloy material as the sidewall of the can. The cap is preferably made of plastic material of sufficient hardness that the cam surfaces do not deform during opening and closing operations.

The cap may be a separate implement, sold separately from the beverage container, and re-used after washing. Also, caps with different features may be provided, such as a cap that has a child's sip cup top, so that the beverage can be converted into a child's sip cup. Other implements can be envisioned, including a cap that has a baby bottle "nipple" formation to convert the beverage can into a baby bottle. In such an embodiment, the contents of the beverage can could be infant formula.

BRIEF DESCRIPTION OF THE DRAWINGS

The details of the present invention, both as to its structure and operation, can best be understood by referring to the accompanying drawings, in which like reference numbers and designations refer to like elements.

DETAILED DESCRIPTION OF THE INVENTION

Figure 1:
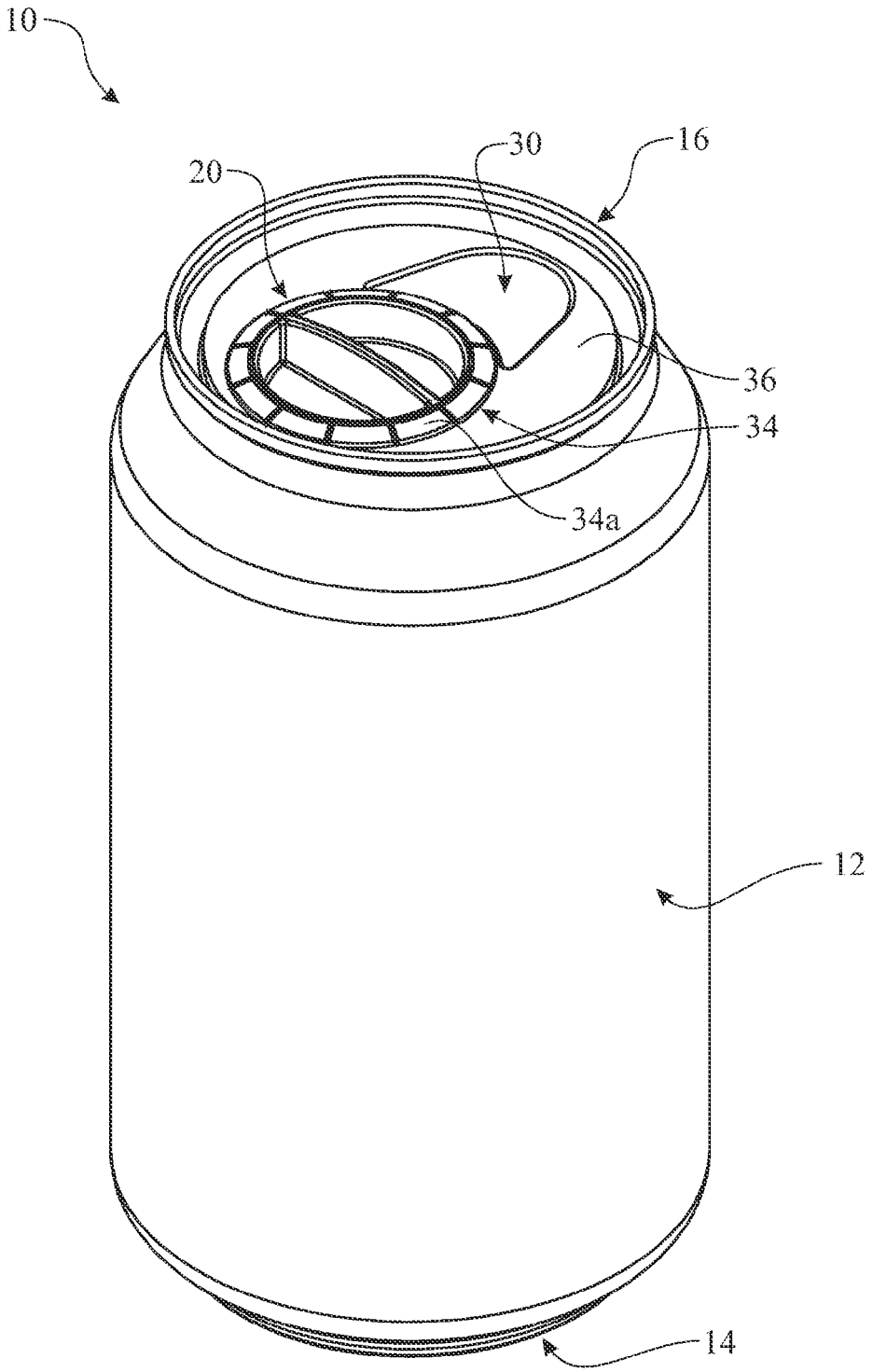
FIG. 1 is a side elevation view showing an example of a beverage container according to the present invention.

Referring to FIGS. 1 through 12, a beverage container 10 includes a cylindrical sidewall 12, a closed bottom wall 14, integrally formed with the sidewall 12 and a lid 16 connected to the sidewall 12 at the end opposite the bottom wall 14. In the illustrated embodiment, the beverage container is a can, wherein the bottom wall 14 and the sidewall 12 are formed from a single piece of aluminum material, using otherwise known processes. The aluminum material is a lightweight aluminum alloy commonly used in the beverage can industry. The lid 16 is preferably made of the same lightweight aluminum alloy material, and is joined at the upper end of the sidewall through likewise known processes. The lid 16 includes a cylindrical socket 18 which extends downwardly into the beverage container 10 from an upper wall 17. The socket 18 is formed near a peripheral edge or lip of the lid 16 as is customary in the art, to allow drinking from the beverage container 10. A cap 20 fits into the socket 18 and engages same in a manner described in more detail below. The cylindrical sidewall 12 of the beverage container 10 is preferably tapered at both the upper and lower ends to provide greater structural integrity, particularly for use with pressurized contents, such as when used for carbonated beverages.

The lid 16 has an outer perimeter that is connected to the upper open end of the sidewall 12 of the beverage container, using known processes, to form an enclosure which contains a beverage. Beverages contained therein are not limited, but include carbonated or non-carbonated beverages, and could also include foodstuffs, and non-edible products. The socket 18 is integrally formed in the upper wall 17 of the lid 16 and includes a cylindrical sidewall 22, which extends downwardly into the beverage container 10, and a bottom wall 24. A score line 26 is formed in the bottom wall 24 in order to create a flap or tear panel 25 (see FIGS. 13B, 13*e* and 13D) which is pushed into the can when the can is opened. In the opened position, the tear panel 25 remains connected to the bottom wall 24 due to the fact that the score line 26 does not make a complete circle or loop; a hinge 28 is created where the bottom wall 24 is not scored (see FIG. 5).

Figure 9:
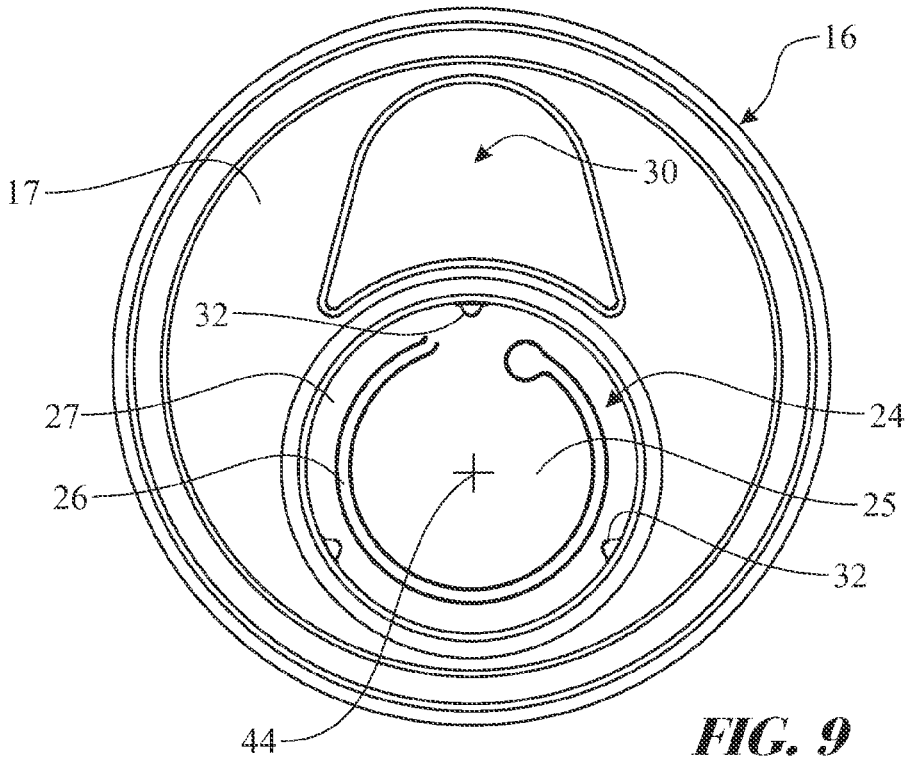
FIG. 9 is a top view of the beverage container of FIG. 8, with the cap removed, showing the projections inside the socket for engaging cam surfaces.

As seen in figures, the cap 20 is sized to fit substantially within the socket 18, and includes a flat annular surface 21 which is disposed between the cam shaped bottom surface 38 and the cap's cylindrical sidewall 40. In FIG. 9, the bottom wall 24 of the socket 18 may include a flat annular surface 27 which is disposed between the socket sidewall 22 and the circular score line 26. When assembled and in the "resealed" position shown in FIG. 13D, the flat annular surface 21 of the cap 20 comes into contact with the annular surface 27 of the bottom of the socket 18 to effectively reseal the container 10.

The lid 16 has a shallow, elongated U-shaped depression 30 which serves two purposes. First, the depression 30 acts as a stiffening structure to provide greater strength to the lid 16. This is particularly advantageous if the lid 16 is to be made of the same aluminum alloy as the sidewall 12 and bottom wall 14 of the container 10. Secondarily, the depression 30 adds a familiar look to consumers who are accustomed to the prior art beverage containers employing a pull tab that is operated first in an opening direction, and then secondly, in a seated direction, where the hinged pull tab is positioned after opening.

Figure 2:
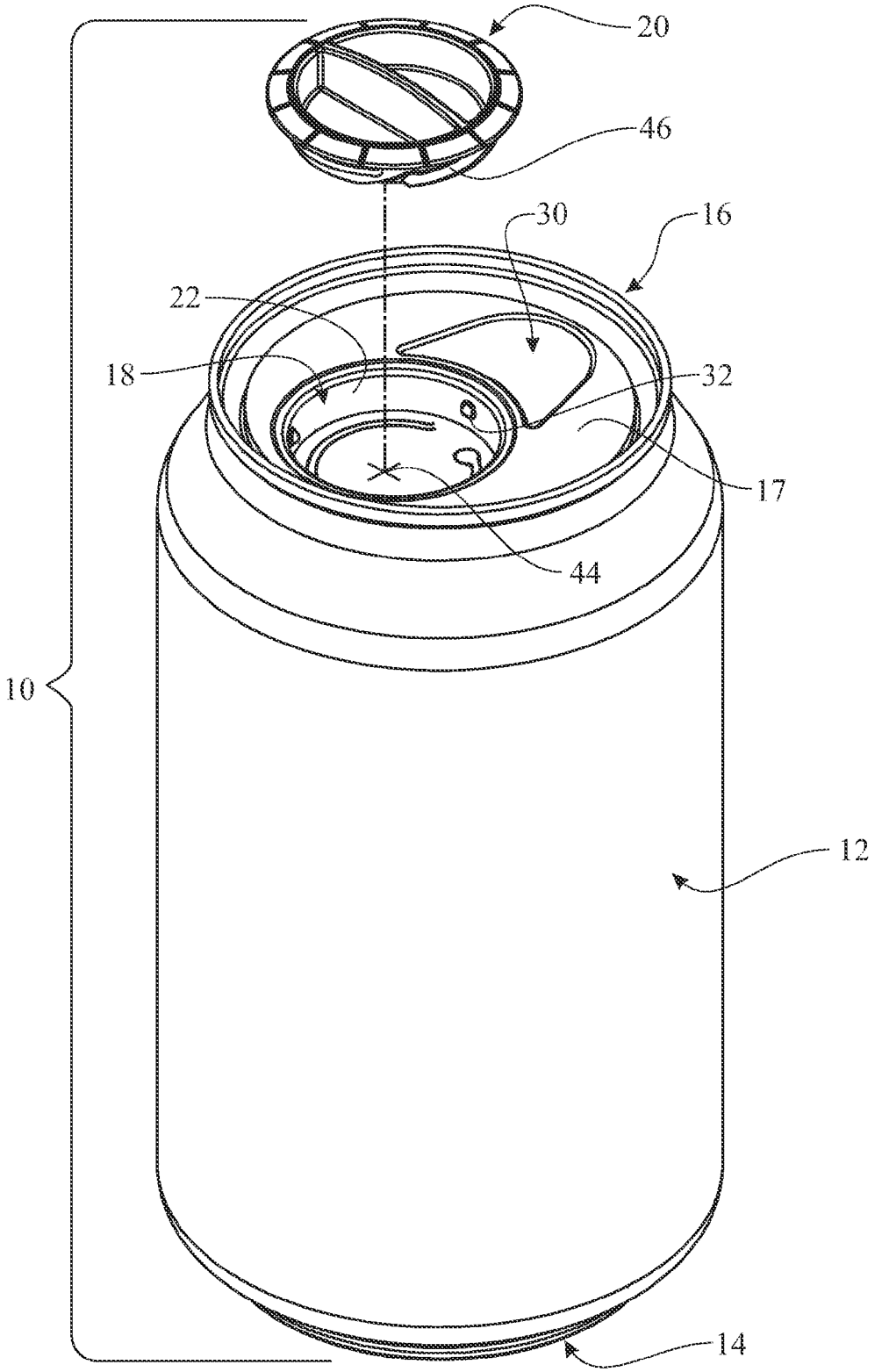
FIG. 2 is a side elevation view, similar to FIG. 1, but exploded to reveal the cap and socket features of the beverage container.
Figure 3:
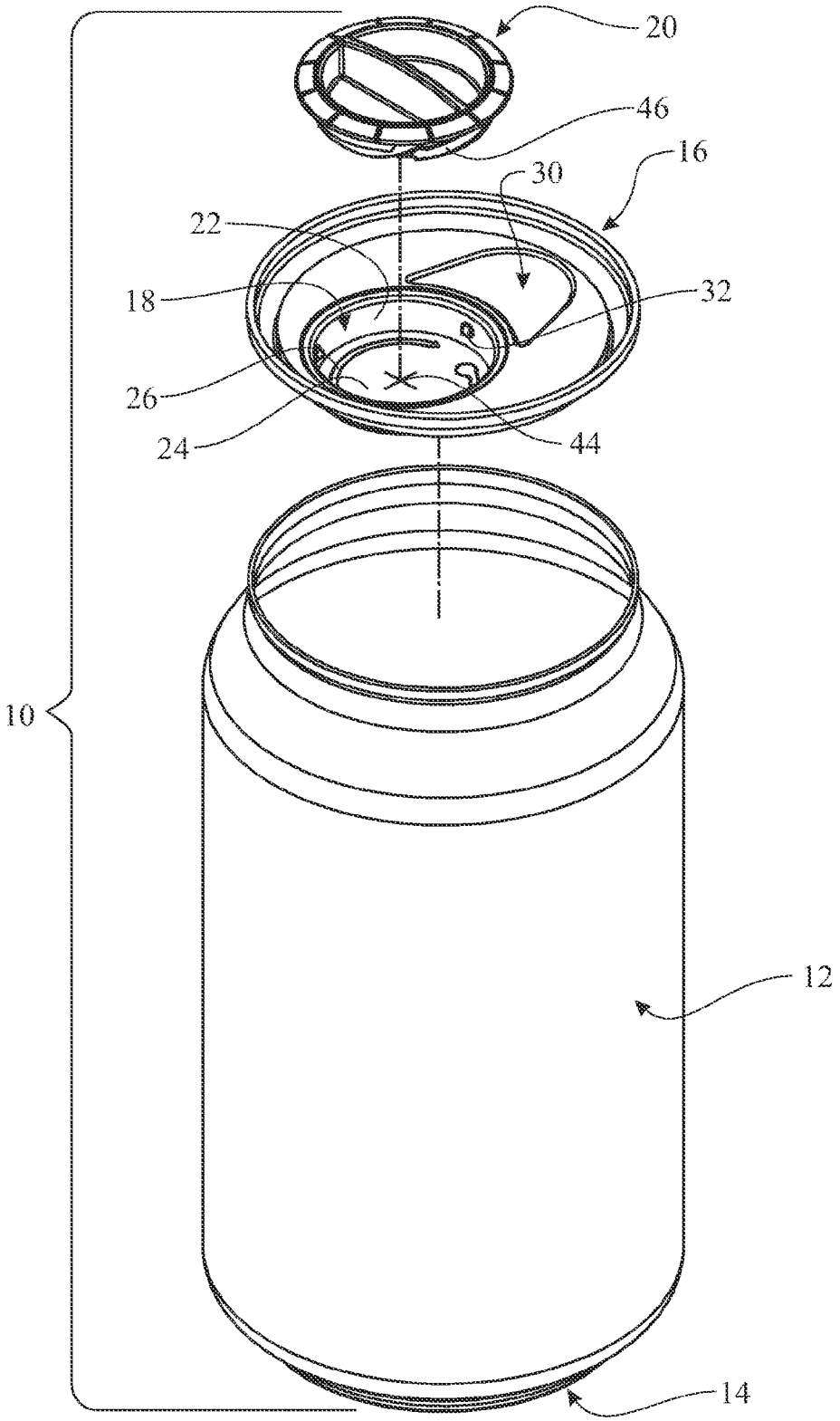
FIG. 3 is a side elevation view, similar to FIGS. 1 and 2, but further exploded to reveal the lid of the beverage container.
Figure 4:
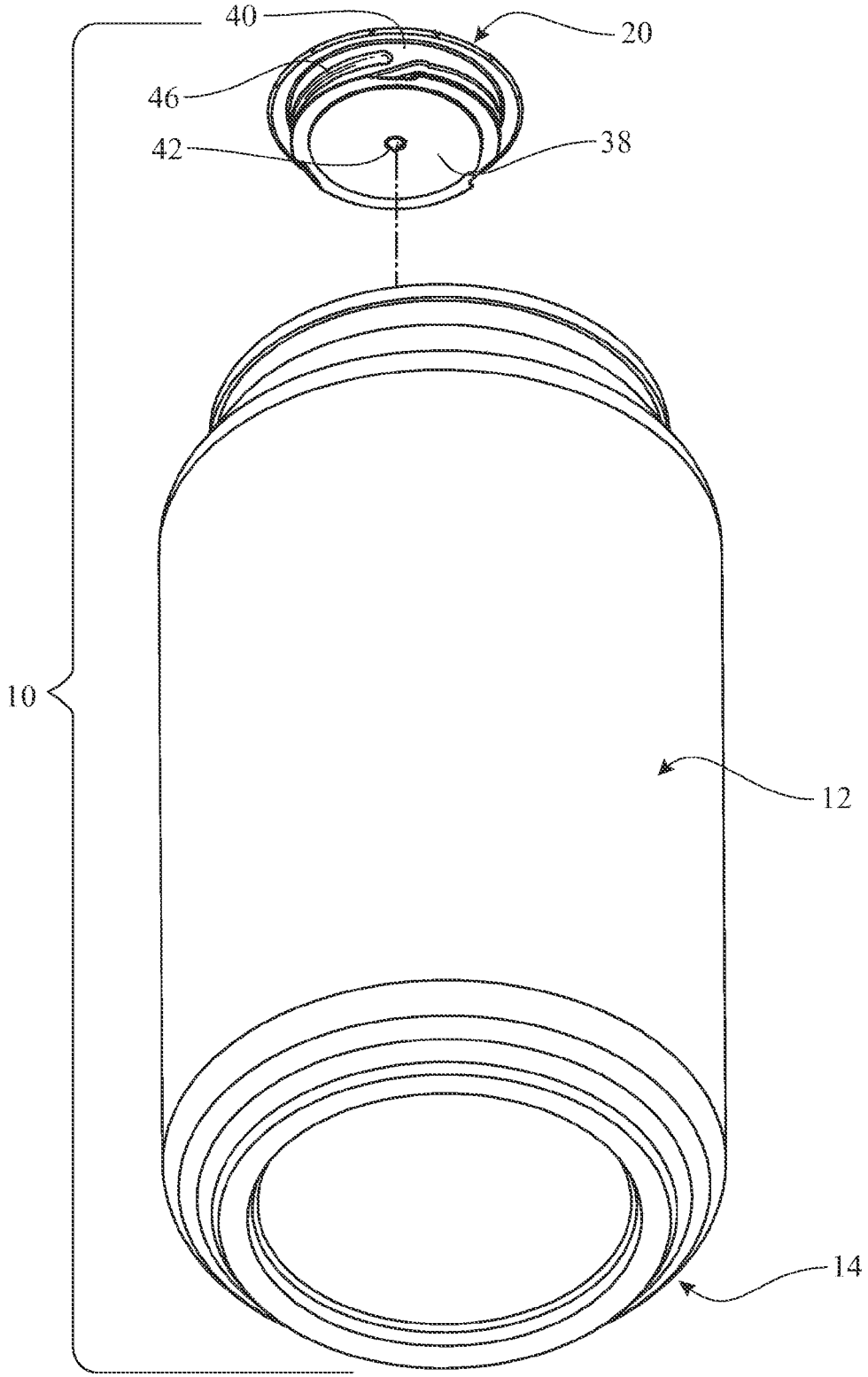
FIG. 4 is an exploded, bottom elevation view of the beverage container of FIGS. 1-3.
Figure 5:
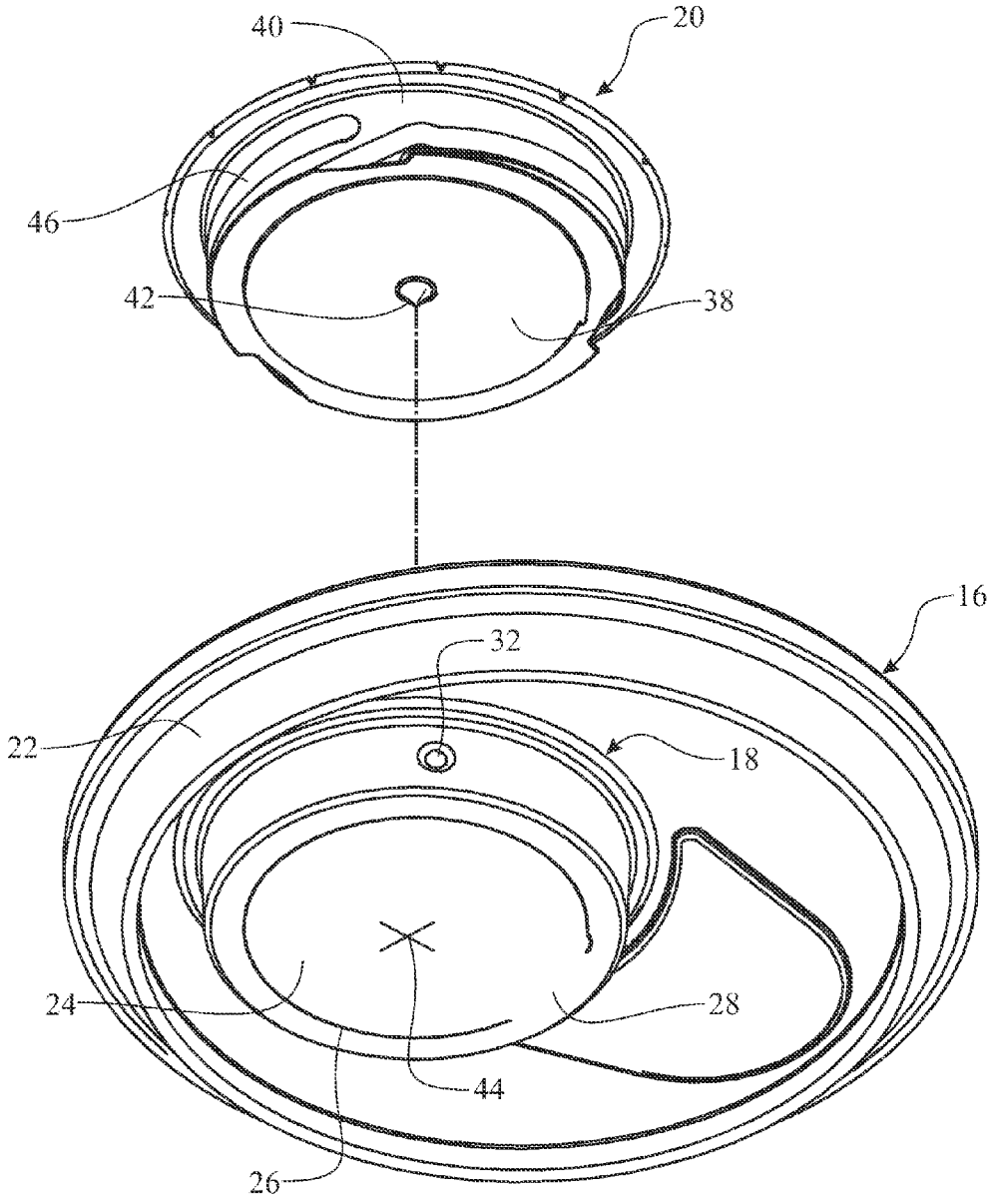
FIG. 5 is an enlarged, bottom elevation and exploded view of the lid and cap of the beverage container of FIGS. 1-4.

As seen in FIGS. 2, 3 and 5, the cylindrical sidewall 22 of the socket 18 has a plurality of equally spaced protrusions 32, disposed substantially on the same plane and being integrally formed in the sidewall 22. FIG. 5 shows one protrusion as an indentation or recess, since FIG. 5 shows the outer cylindrical sidewall of the socket 16, whereas the other Figures show the inner cylindrical sidewall 22 of the socket 16. The protrusions 32 cooperate with the cap 20 in a manner described below in order to open and reseal the container 10.

Figure 6:
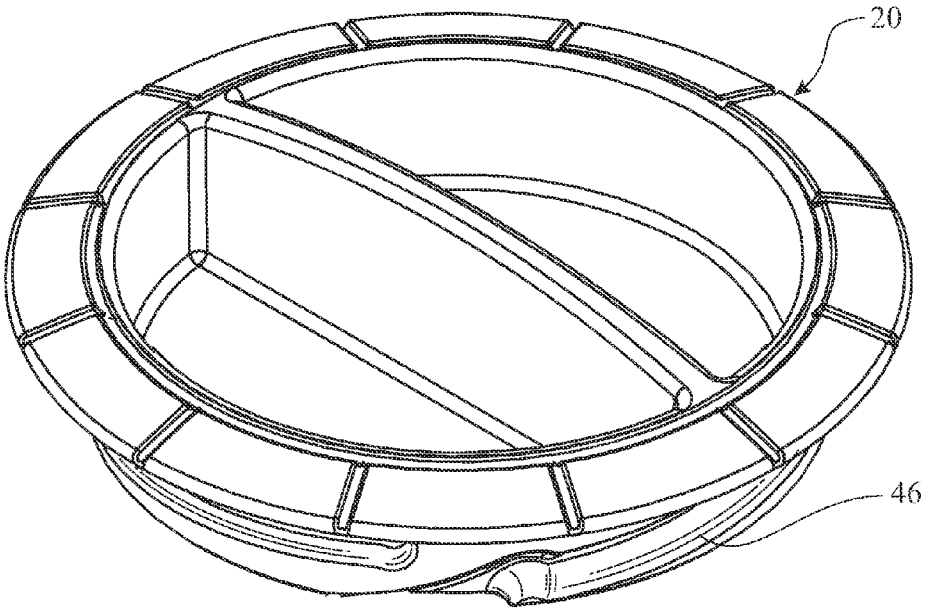
FIG. 6 is an enlarged, top side elevation view of the cap used in the previous figures.
Figure 7:
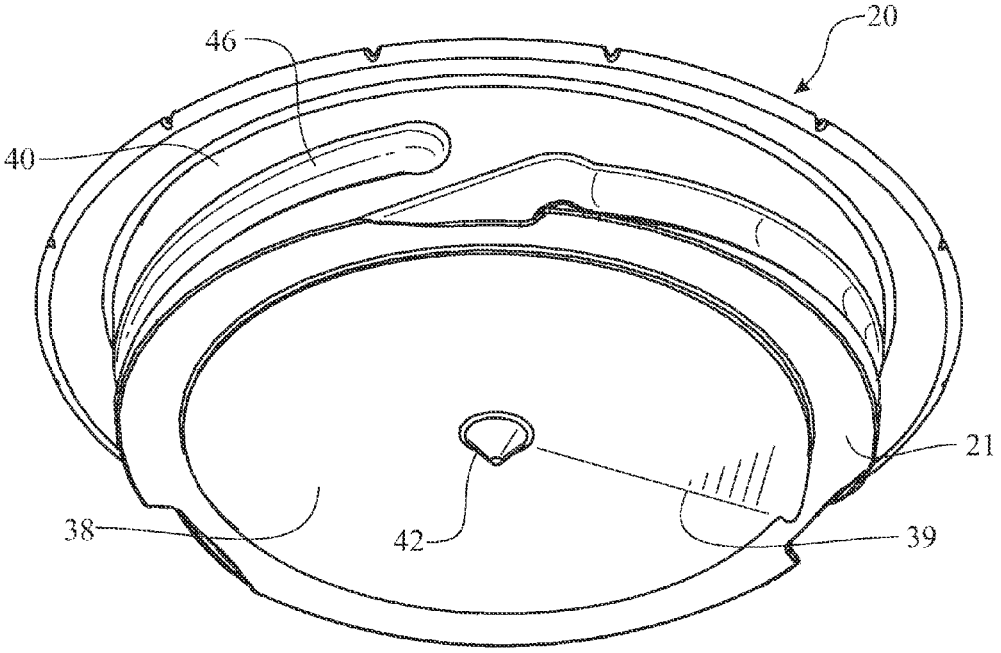
FIG. 7 is an enlarged, bottom side elevation view of the cap used in the previous figures.

Referring to FIGS. 5-7, the cap 20 has an upper, radially extending skirt 34 which acts as a tamper proof indicator. As seen in FIG. 1, prior to opening the beverage container 10, the skirt 34 seats flush with the flat outer surface 36 of the lid 16. The skirt is integrally formed with the cap 20, which is preferably made of plastic material. The skirt 34 includes a series of frangible score lines 34*a*, extending radially outwardly, which are operable to break during the opening operation of the can. The breaking of the score lines is effected by the skirt being driven downwardly as the cap is twisted or rotated and thereby advances downwardly into the socket 18. Opening of the beverage container will thus be evident by the broken score lines of the skirt 34, and preferably, by the sections of the skirt 34 that are formed by the broken score lines extending at an angle upwardly, thus extending radially outwardly and radially upwardly.

The cap 20 is preferably made of a molded plastic material, is sized to fit substantially within the socket 18, and includes a cam shaped bottom surface 38 formed at the lower or inner end of a substantially cylindrical sidewall 40. The cam shaped surface 38 may include an integrally formed sharp or pointed projection 39 disposed offset to the center axis of the cap 20 and extending downwardly into the socket 18 when the cap 20 is assembled in the socket 18. When assembled, the sharp projection 39 is disposed immediately above the score line 26, so that when the cap 20 moves downwardly during opening of the container 10 projection 39 punctures the can at the beginning of the score line 26, next to the tab hinge 28, then progressively propagates the rupture along the score line 26 to its terminus on the opposite end of the tab hinge 28.

The cam shaped bottom surface 38 may also include a sharp or pointed projection 42 disposed on the center axis of the cap 20 and extending downwardly into the socket 18 when the cap 20 is assembled in the socket 18. When assembled, the projection is disposed immediate above an X-shaped score line 44, so that when the cap 20 moves downwardly during opening of the container, the projection punctures the can at the X-shaped score line 44, thereby relieving internal pressure and assisting in the rupturing of the score line 26 by the sharp projection 39.

The opening operation of the beverage container 10 is made possible by forming a cam structure between the socket 18 and the cap 20. In particular, cam surfaces 46 are formed in the cylindrical sidewall 40 of the cap 20. The projections 32 are fitted into and engage the cam surfaces 46 such that when the cap 20 is hand-twisted by the consumer, rotational motion of the cap 20 is converted into linear motion of the cap 20 thus driving the cap in a downward direction relative to the socket 18. As the cap 20 moves downwardly, the score line 26 is ruptured by the sharp projection 39, then progressively propagates the rupture along the score line 26 to its terminus. In an alternate embodiment, an optional X-shaped score line 44 may be ruptured by the projection 42 immediately before the score line 26 is ruptured by the sharp projection 39, to thereby relieve internal pressure and assist in the rupture of the score line 26 by the sharp projection 39.

Figure 8:
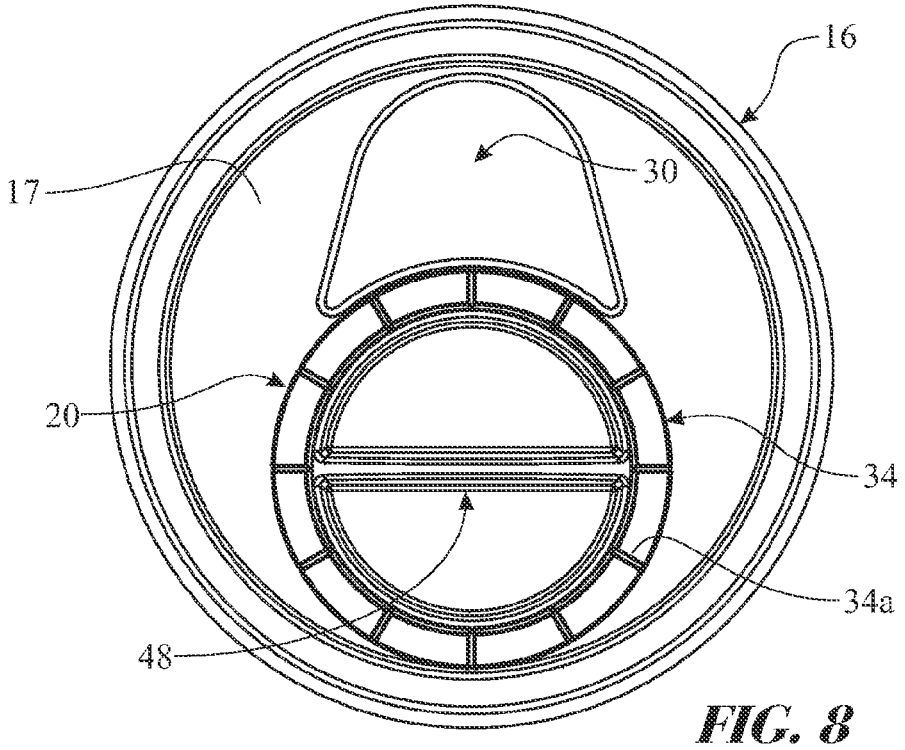
FIG. 8 is a top view of the beverage container of the previous figures, showing the cap in a pre-opened position.

As seen in FIG. 8, the cap 20 includes a grip element 48 for the consumer to grab when ready to open the beverage container, and also, as described below, for resealing the beverage container after opening. Depending on the contour of the cam surfaces and their direction of orientation, the cap can be rotated in one direction, preferably clockwise for opening, and then in the opposite direction, counterclockwise, to remove the cap during consumption of beverage, and then again back to the can-opening direction for resealing the beverage container if the contents are not entirely consumed. FIG. 9 shows the symmetry of disposition of the three projections 32, at approximately equal angular intervals of 120 degrees. Each projection engages a corresponding cam element, such that in the illustrated embodiment, the sidewall 40 of the cap 20 would be contoured, as by forming grooves, to form three cam elements 46*a*, 46*b*, and 46*c*. The cam elements are shaped and sloped in a manner designed to cause the cap 20 to advance into an opening position without more than a quarter to half a turn, and as measured in radians, this would be no more than 1 to 2 radians. The number of projections and cam elements can be varied, although three provides a balance between cost and effectiveness.

Figure 10:
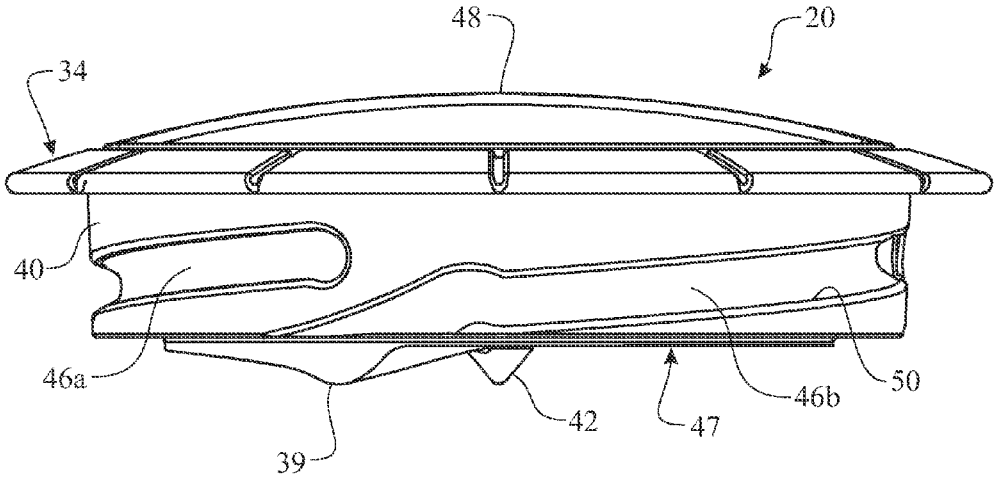
FIG. 10 is a side elevation view of the cap, enlarged to show the cam surfaces on the cylindrical sidewall of the cap.
Figure 11:
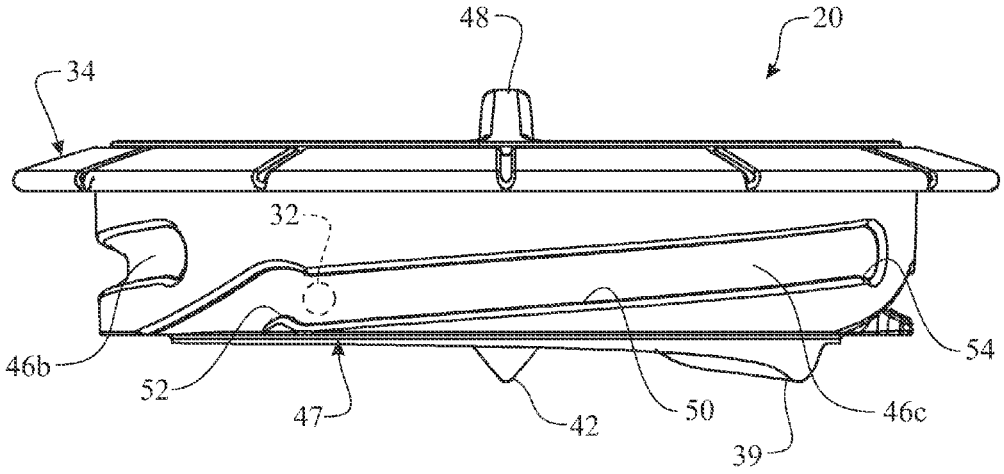
FIG. 11 is a side elevation view of the cap of FIG. 10, rotated 90 degrees.
Figure 12:
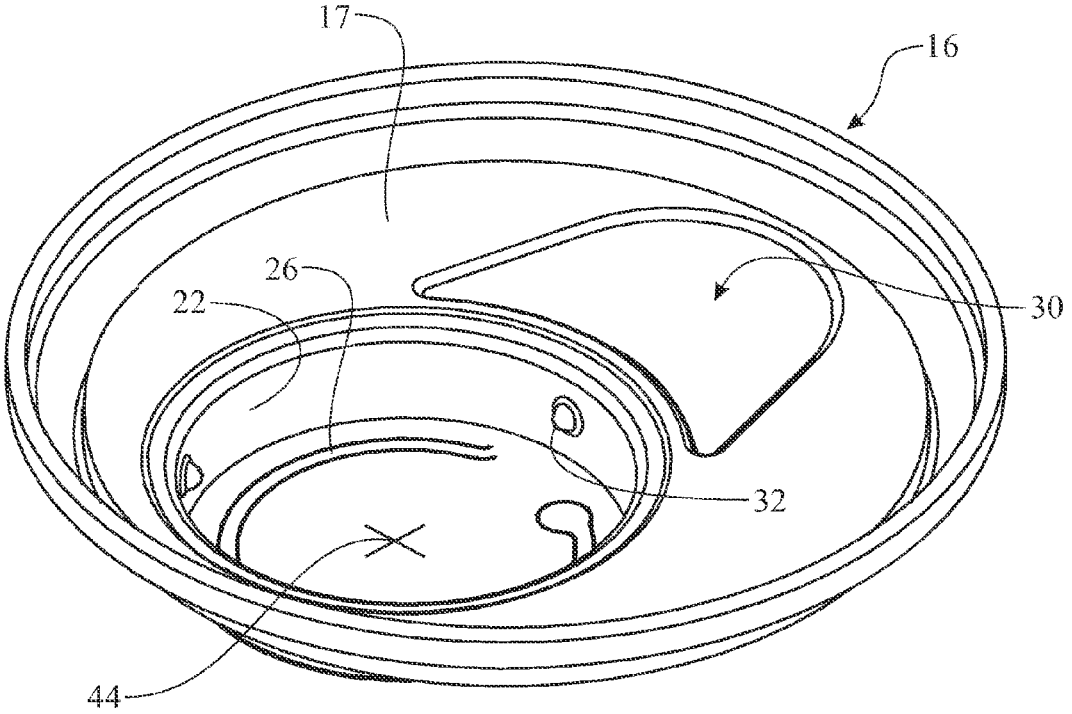
FIG. 12 is a top elevation view, showing the top of the beverage container, or lid, with the cap removed to expose features of the socket.

Referring to FIGS. 10 and 11, the cap sidewall 40 includes three equally spaced cam elements 46*a*, 46*b* and 46*c*. FIG. 10 shows the cam elements 46*a* and 46*b* and the grip 48 extending across the page. The bottom surface 47 of the cap 20 includes the projection 42, acting as a piercing element, which punctures the X-shaped score line 44, and it further includes a further projection 39 which also acts as a piercing element. The projection is designed and shaped to impinge on the bottom wall 24 of the socket 18 inside and juxtaposed the score line 26. As the cap 20 is rotated, from the unopened position shown in FIG. 10, the cam structure turns the rotational movement to translational movement, thus moving the cap inwardly. As the cap 20 moves inwardly, the projection 39 rotates until, preferably, it reaches the position shown in FIG. 11, wherein a portion of the bottom wall 24 breaks away and is pushed inwardly to form the tear panel 25 that remains hinged to the bottom wall 24 by virtue of the score line 26 not extending to a complete loop. The projection 39 starts at the beginning of score line 26 and only travels 90 degrees. Thus, it will only have traveled a portion of the length. What pushes the tear panel 25 out of the way is the body of the cam shaped bottom surface 38 going past the plane of the socket 18 bottom wall 24. Notice that the cam shaped bottom surface 38 protrudes out from the flat annular surface 21.

Figure 13A:
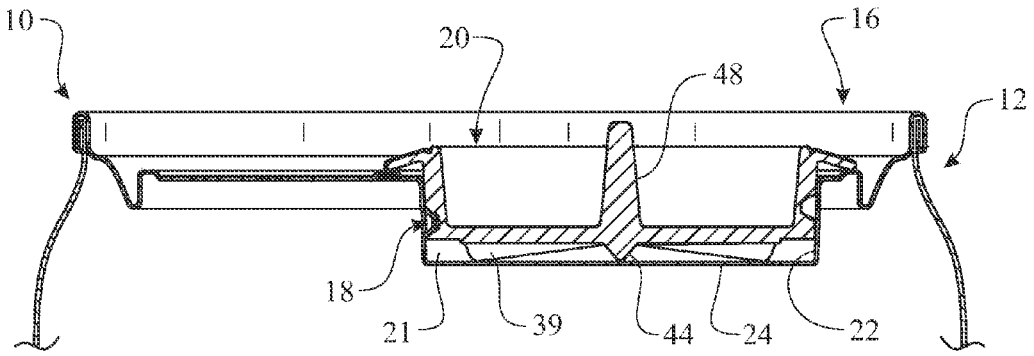
FIG. 13A through 13D show cross sectional views of the cap moving sequentially between opening and resealing positions.

FIGS. 13A through 13D show a cross sectional view of the cap moving between opening and resealing positions. In FIG. 13A, the cap 20 is shown in cross section prior to opening the beverage container. Thus, the bottom wall 24 of the socket 18, the cylindrical sidewall 22 of the socket 18, and the upper horizontal wall 23 form the lid 16. As seen in FIG. 13A, the cap 20 is shown in the storage position, i.e., pre-opening of the can, wherein the socket bottom 24 is not punctured and the contents of the beverage can 10 are air tight for potentially long term storage. The grip element 48 is shown in a first, unopened position. In this position the flat annular surface 21 of the cap 20 is spaced above the socket bottom wall 24, but the projection 39 is close to or in slight contact with the score line 26. Similarly, if a second projection 42 is employed at the center of the lower end of the cap 20, it is also disposed in close proximity to the score line 44 if not slightly touching.

Figure 13B:
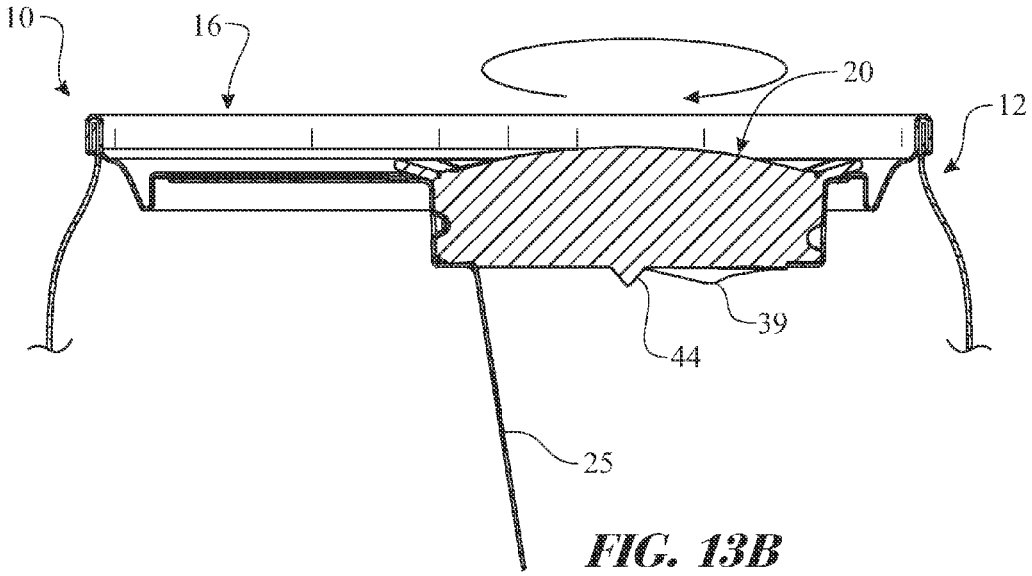

In FIG. 13B, the cap 20 is rotated clockwise approximately 90 degrees. Because of the cam surfaces, the cap translates downwardly by a distance sufficient to cause the projection 39 to rupture the score line 26 as the projection moves along the inner side of the score line. The rupture creates a tear panel 25 which is pushed by the projection into the can by rotating downwardly from the hinge 28 formed between the opposite ends of the score line 26. The opposite ends of the score line are positioned to form a pivot axis for the tear panel 25.

Figure 13C:
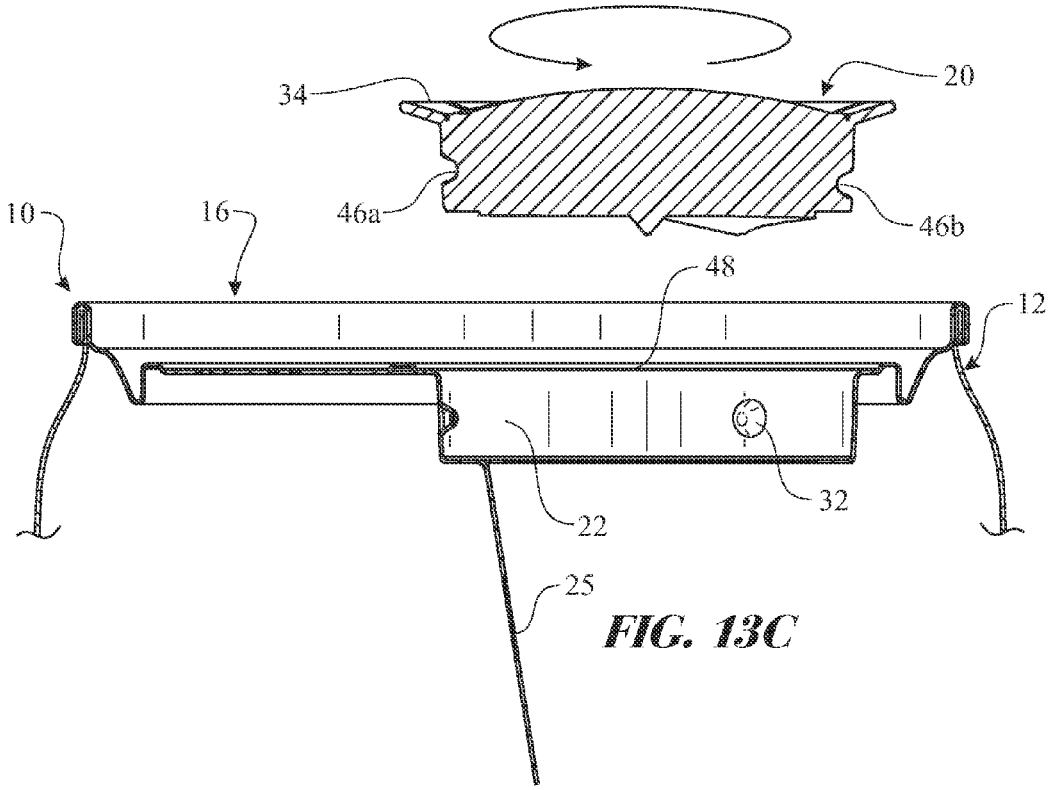

After the tear panel 25 is formed, and the cap is disposed at its innermost position relative to the socket, the consumer would then rotate the cap counterclockwise, preferably by turning the grip element 48. As seen in FIG. 13C, the cap 20 is shown separated from the beverage container 10, and can be pocketed by the consumer, or placed in a location for easy access in case the consumer chooses not to consume the entire contents of the beverage container 10. As evidence that the beverage container has been opened, the skirt 34 may be angled upwardly as a result of the frangible score lines being broken, so that individual sections of the skirt are now biased in an upward direction. Also, when rotating counterclockwise, the cam surfaces 46 and the projections 32 will eventually separate, allowing the cap 20 to be free of the beverage container 10.

Figure 13D:
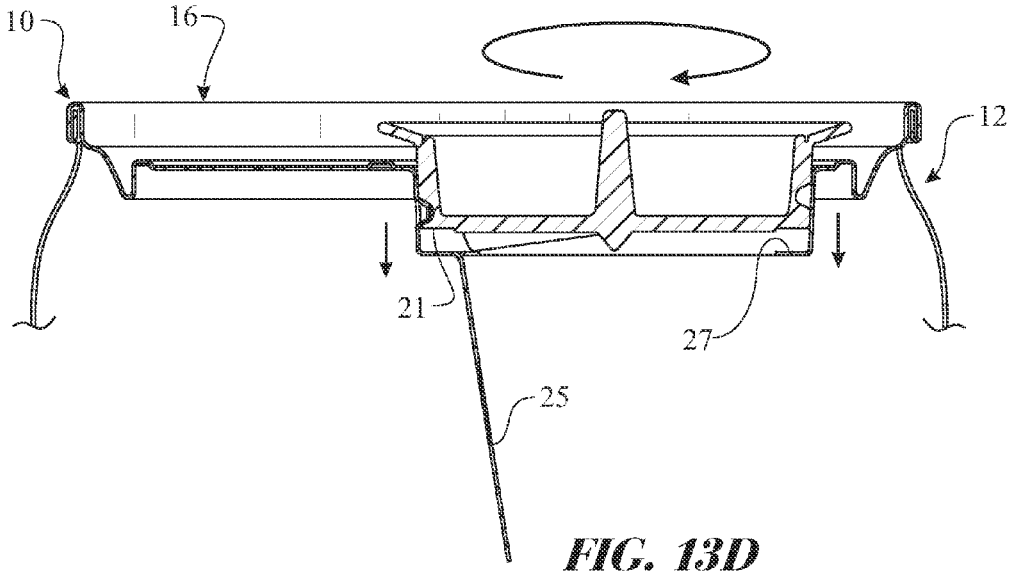

In the event that the consumer wishes to reseal the beverage container 10, and as seen in FIG. 13D, the cap 20 is brought into contact with the socket 18 by the consumer, by bringing the cam surfaces 46 into engagement with the projections 32. Once this occurs, clockwise rotation will cause the cap 20 to translate downwardly until a sealing, seating arrangement is made between the annular surface 27 of the socket bottom wall 24 and the annular surface 21 of the cap 20, thereby keeping the contents of the beverage container fresh and safe from foreign contaminants.

The cap 20 can be removed again and again to gain access to the contents of the beverage container until all contents are consumed. There is no limit to the type of beverages that can be housed in the container 10, but most commonly "canned" beverages include sodas, beer, juices, etc. It is also within the scope of the present invention that the contents of the containers could be foodstuff, and non-consumable liquids, gels, powders, etc.

The cam means disclosed herein can be used for caps that provide other functionality for the beverage can 10. For example, a variation of the cap 20 would be one that could include a passageway extending through the cap 20 with drinking implements formed at the upper, outer end, such as a child's sip cup, which would allow a child to drink from the beverage container 10 without spilling. Alternatively, the cap 20 could be formed with an infant nipple for feeding formula, juice, water or other beverages suitable for infants. When using drinking implements such as sip cup and baby bottle nipples, a cap 20 would nonetheless have to be employed for opening the container, and then a second "cap" could be used for consuming the contents. In any event, the opening caps and drinking implements could be sold separately from the beverage container, as long as the container included the projections formed in the cylindrical sidewall of the socket.

Although a wide range of plastic materials could be used to form the cap 20, other materials could be used, including ceramics and metals. However, for harder materials such as these, it may be necessary to position a gasket between the opposing annular surfaces of the socket and the cap to ensure the best possible seal.

While the embodiments described herein place the socket and cap in the top of the beverage can, it is possible to have the same opening and resealing structures in the bottom surface 14 of the beverage container 10. Also, while a cylindrical can has been described herein, other shapes of containers, e.g., oval, rectangular, etc., could also be used.

The preferred shape of the frangible score line 26 in the bottom of the socket 18 is circular, with a closed end and an open end. The inside score (shallower line) terminates in a curve arcing towards the socket's cylindrical sidewall to prevent loss of tear panel into the container. The outside score line (deeper line) terminates in circular form spaced from the inside score line. There is a hinged portion of the tear panel that keeps the panel in contact with the lid once ruptured, as described above.

The projection 39, described as a piercing element, is intended to be a single point of contact that moves deeper, and radially along the inside of the score line 26 while the cap 20 is rotated. The projection 39 may also include additional areas to further drive the tear panel 25 deeper into the container. A single point will apply more force to breaking the tear panel but additional areas acting in a secondary fashion could help in the opening process.

The projections 32 used in the socket allow the use of a very shallow socket (as compared to threaded designs) and still provide positive opening, closing and sealing of the cap 20. The design of the projections 32 also provides for positive stops for open, closed and removable cap positions. As seen in FIGS. 10 and 11, each cam element 46*a*, 46*b* and 46*c* includes a sloped portion 50, a lower detent 52 and an upper detent 54. Once assembled, the three projections 32 are respectively positioned so that the detents prevent the cap 20 from becoming disconnected from the socket 18, during transport or storage, and from backing off a sealing position, when the cap 20 is positioned in a resealing position. This can be illustrated with reference to FIG. 11, where the projection 32 is shown as a broken line circle. When the cap 20 is in the unopened position, each projection 32 will be positioned next to the lower detent 52, as seen with the broken line circle 32. The detent 52 prevents the cap 20 from turning to a position where the projection 32 is disengaged from the cam element 46*c*, as for example, if vibration or the like caused the projection to pass out of the sloped portion 50. Similarly, when the cap 20 is intentionally rotated clockwise, to either open or reseal the beverage container, the projection passes over the upper detent 54 to become locked by interference fit between the detent and the projection. The upper detent thus prevents the cap 20 from inadvertently backing out of the sealing position. Thus, the cap 20 is held in two positions by the detents. The first position can be called a transport securement position and the second can be called a closed position. The distance between the two detents, measured along the rotational axis of the cap 20 is equal to the distance between the resealing surface on the cap 20 and the socket's bottom surface. The transport securement detent, or lower detent 52 restricts the rotary movement of the cap 20 due to the interference between the stabilizing skirt 34 and the flat upper rim of the socket 20, as well as the interference between the piercing element or projection 39 and the socket tear panel 25.

When turning the cap 20 in the opening direction, e.g., clockwise, the projections 32 on the socket's cylindrical sidewall follow the sloped portions 50 of the cam elements 46, which form gradual ramps, and this causes the rotary motion of the cap 20 to be converted to linear or translational movement which drives the cap 20 into the container. This engages the piercing element 39 against the tear panel 25 and provides the force necessary to rupture the frangible score line 26. Further turning of the cap 20 in the opening direction progressively pushes the tear panel 25 out of the way and into the container, until the projections 32 reach the closed position of the upper detents 54. A slightly higher point on the sloped portion 50 of the cam elements 46 just before the closed position provides the resistance necessary to keep the cap from backing out.

When turning the cap 20 opposite the opening direction, the projections 32 follow the same route to their starting positions but after opening, the projections 32 can pass over the transport securement or lower detents 52 because the stabilizing skirt 34 and the tear panel 25 are now not providing any interference between the transport securement or lower detents 52 and the void between the cam elements 46, allowing the cap 20 to be freed from the container.

In the embodiments described and illustrated herein, the cam elements 46 are seen as grooves having a sloped portion that terminated at opposite upper and lower ends in a detent, whereby the entire cam elements were formed in the cylindrical sidewall 40 of the cap 20. It is equally possible to form the cam elements as projections from the surface, integrally formed therewith, or as separate parts connected to the cap. Further, while the projections 32, acting as cam followers, project from the cylindrical sidewall of the sockets, the socket could have been formed with cam surfaces and the cam followers could have been formed on the cap 20. The exact size and shapes of the cam surfaces can be selected to correspond to the particular needs of the beverage container. The overall goal is to select a structure that results in an operable torque which can be applied by consumers without exerting excessive effort.

Figure 14:
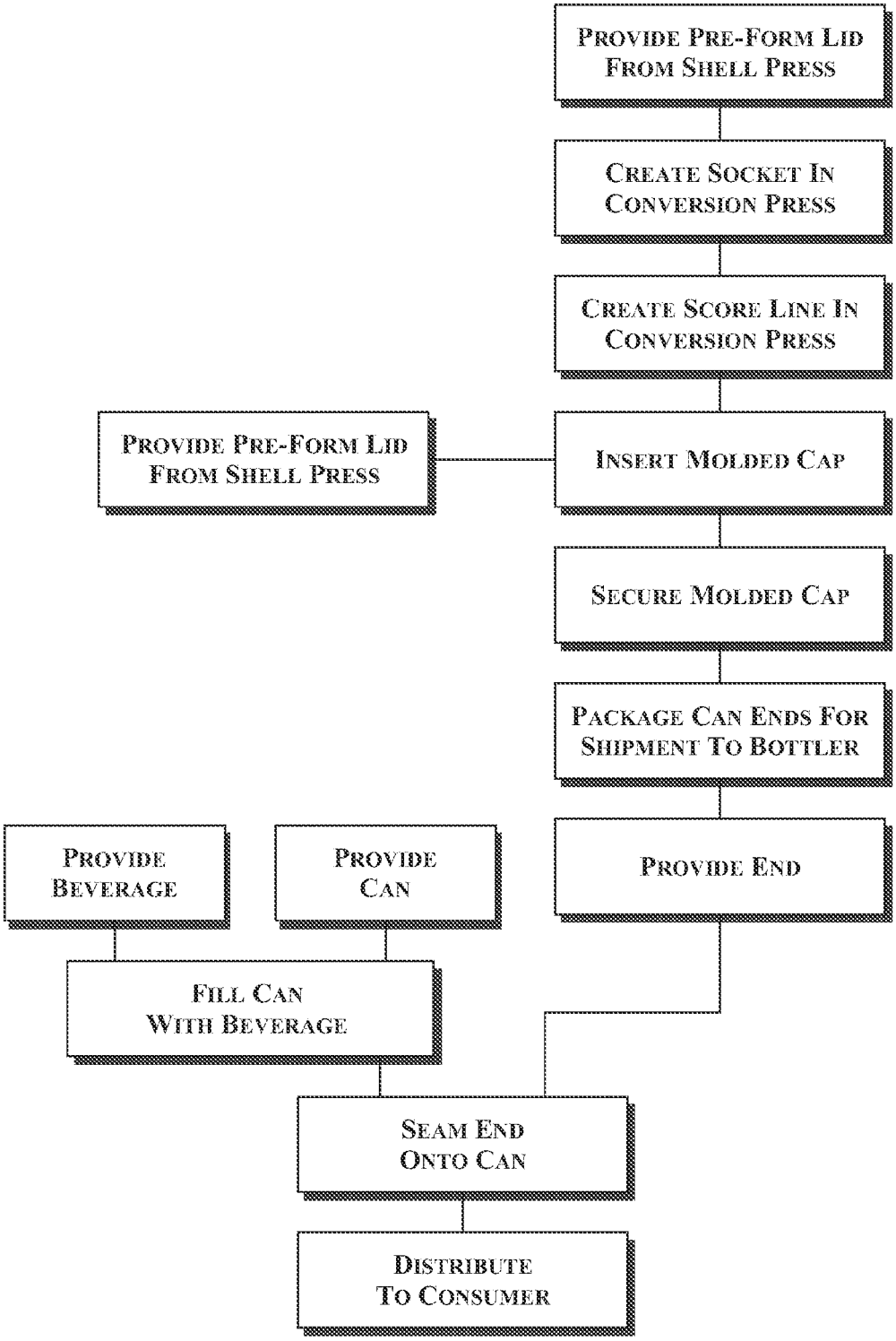
FIG. 14 is a flow chart showing manufacturing steps according to one aspect of the present invention.

The structures described above can be made using unique manufacturing processes, which combine some of the known processing steps with new, modified or avoided steps. In one particularly preferred method of making beverage containers, as illustrated in the flow chart of FIG. 14, preformed lids are provided from a shell press. Next, sockets are formed in the lids in a conversion press. Next, a score line is formed in the bottom of the socket in the conversion press, either at the same time, or sequentially after the socket is formed. Caps are formed by injection molding, or other suitable means, and the caps are supplied to the assembly line, where they are inserted into the sockets. The caps are then secured to the sockets by press forming the projections by spacing three dies around the socket, all centered on a common plane. The dies are pressed inwardly against the cylindrical sidewall of the socket, and the cap acts as a mandrel against the inner pressing force of the dies, thus forming the projections 32 to project into the grooves of the cam elements. The can lids or ends are then packaged and sent to bottlers, who can then use conventional processing steps to secure the lid to any of a variety of cans or other beverage containers.

The process described above achieves several cost and environmental advantages over the prior manufacturing techniques. First of all, the lid does not have to be processed to form a rivet, which has conventionally been used to secure the pull tab to the can lid. There is no need for a rivet because there is no need for a pull tab. The rivet required the lid to be made of stronger, thicker material, usually consisting of a different alloy of aluminum as opposed to the material that made up the sidewall and bottom. Moreover, the conventional process would have required the formation of a pull tab, likely to be made of third, different aluminum alloy. Use of three different aluminum materials presented a problem for recycling, whereas in the present invention, a single material can be used to form the can body and the can lid.

Figure 15:
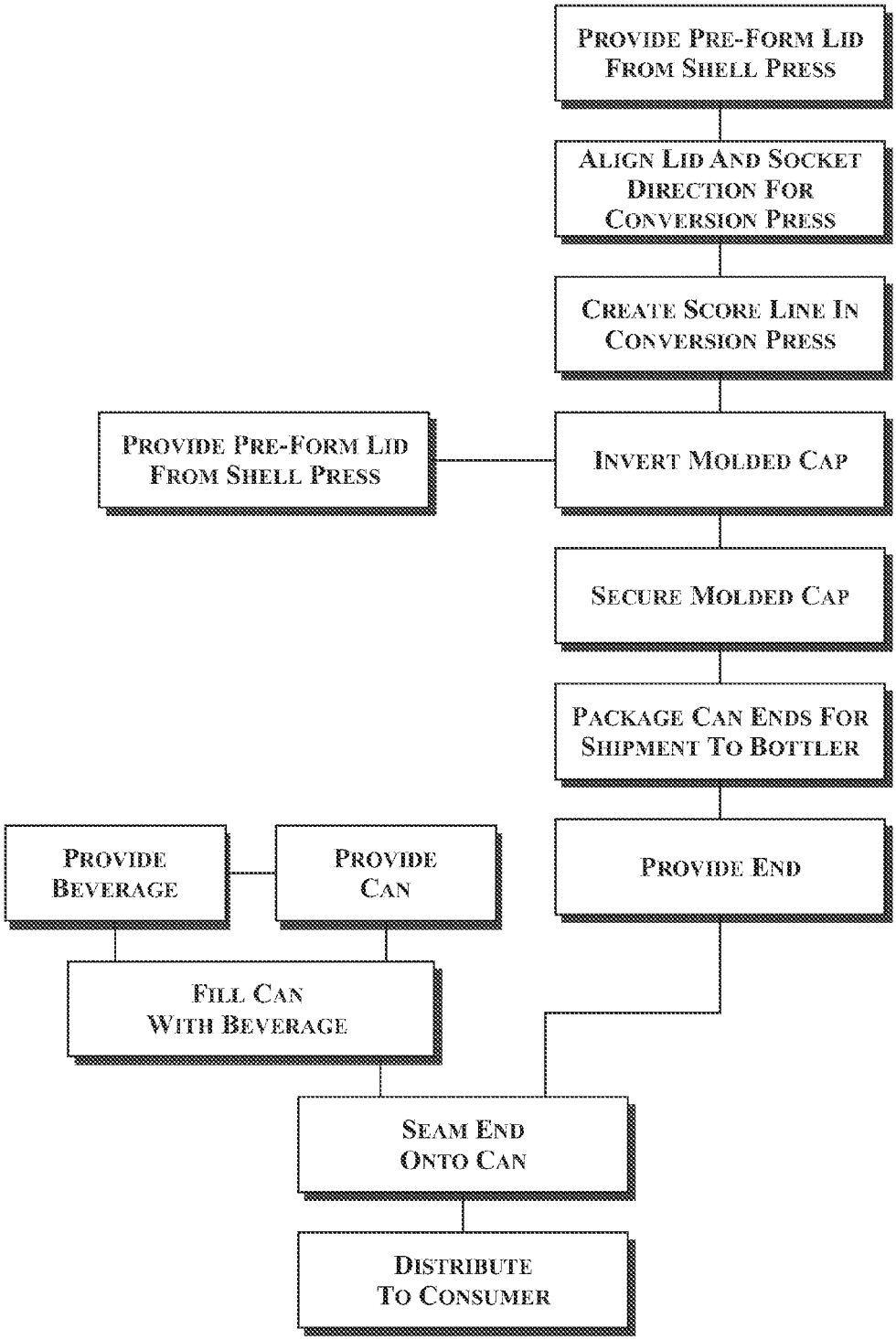
FIG. 15 is a flow chart showing manufacturing steps according to another aspect of the present invention.
Figure 16:
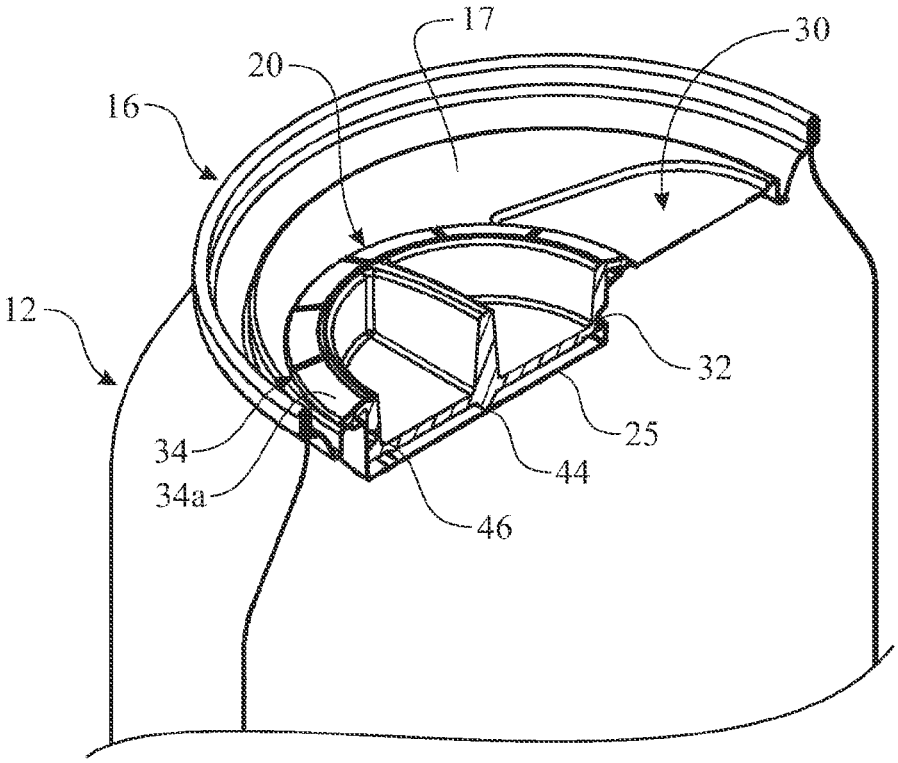
FIG. 16 is a partial cutaway, partial section of the beverage container of the previous drawings.
Figure 17:
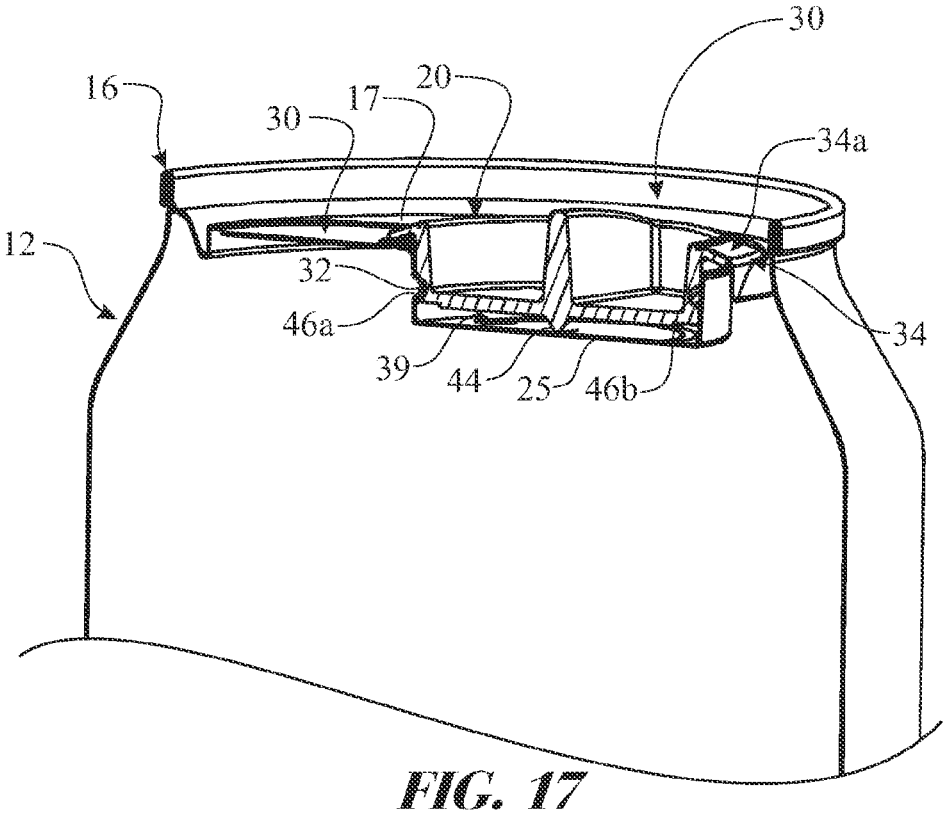
FIG. 17 is the same view as FIG. 16, but from a different point of view.
Figure 18:
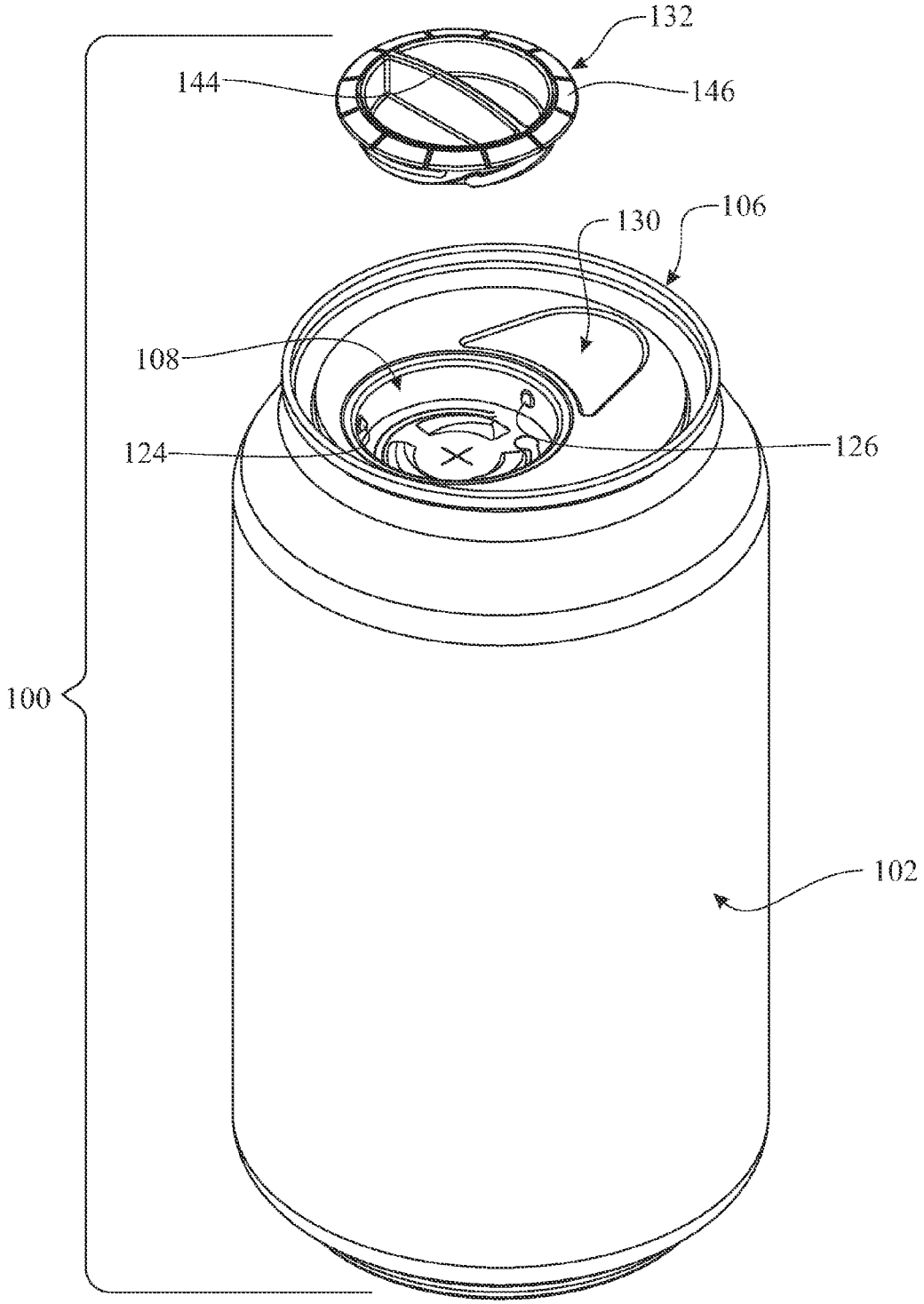
FIG. 18 is a side perspective view of a beverage container of another embodiment of the present invention.
Figure 19:
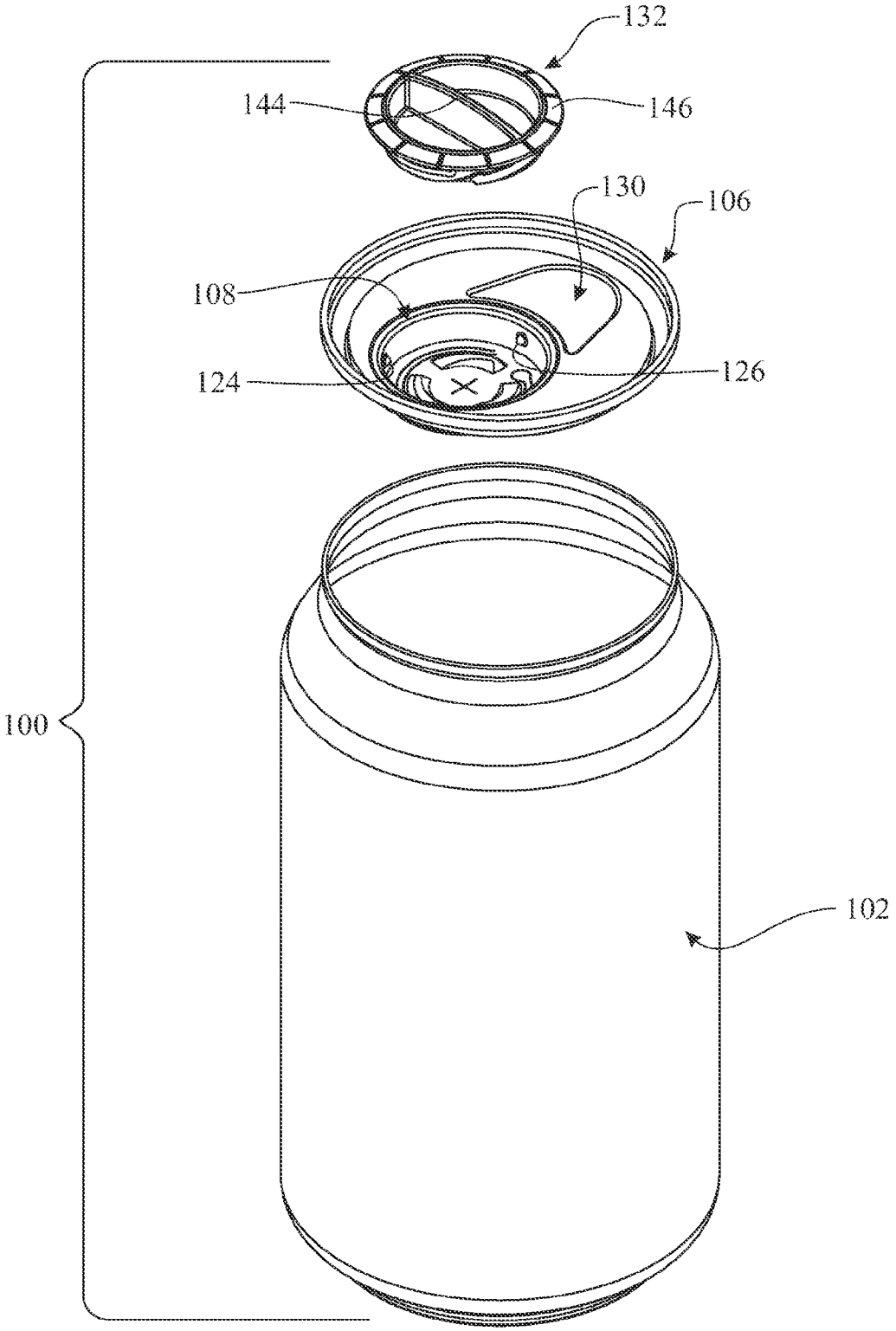
FIG. 19, is a side perspective view of the beverage container of FIG. 18, exploded to show the beverage container of FIG. 18.
Figure 20:
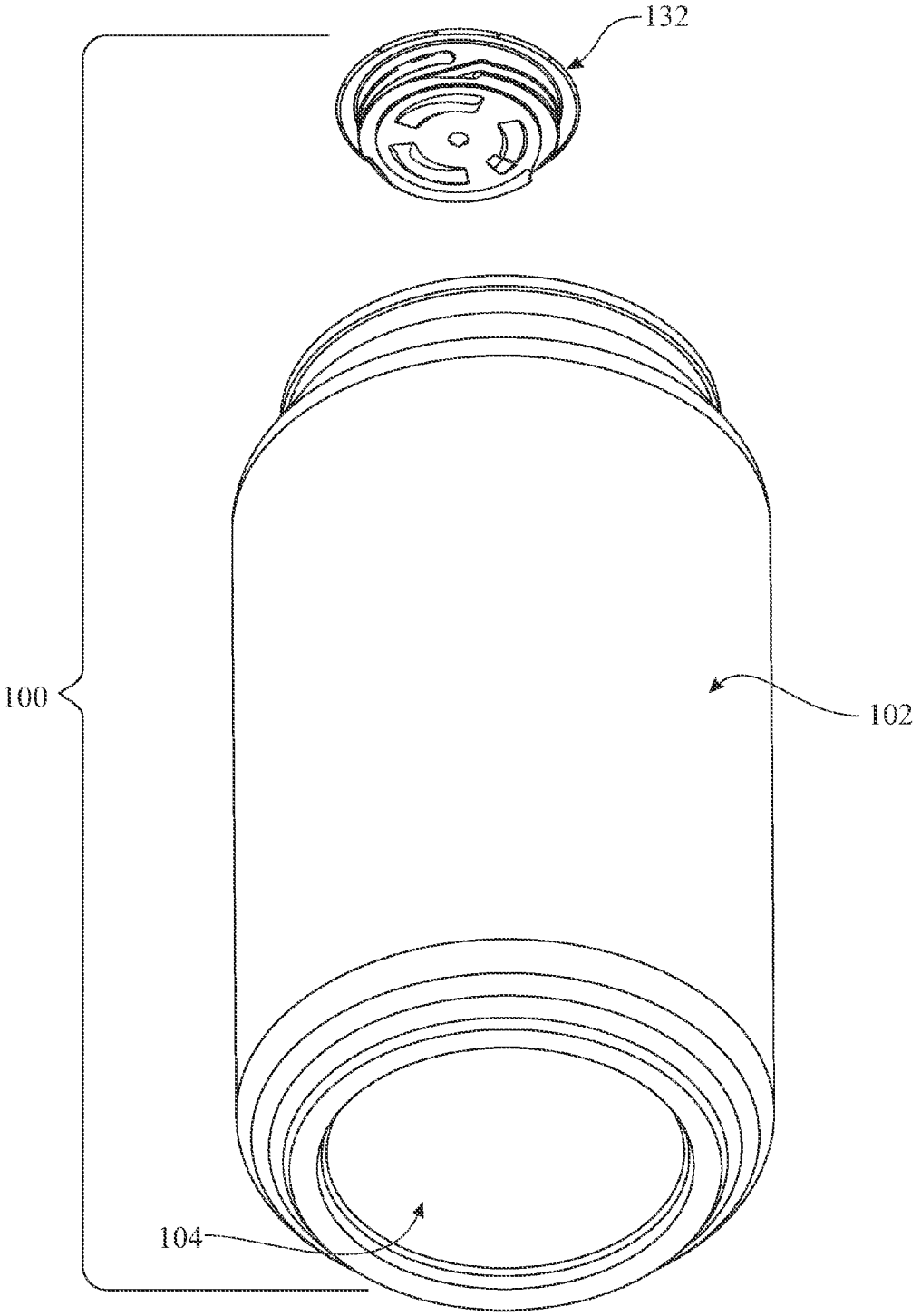
FIG. 20 is a bottom perspective view of the beverage container of FIG. 18, showing features of the cap, which is separated from the beverage container.
Figure 21:
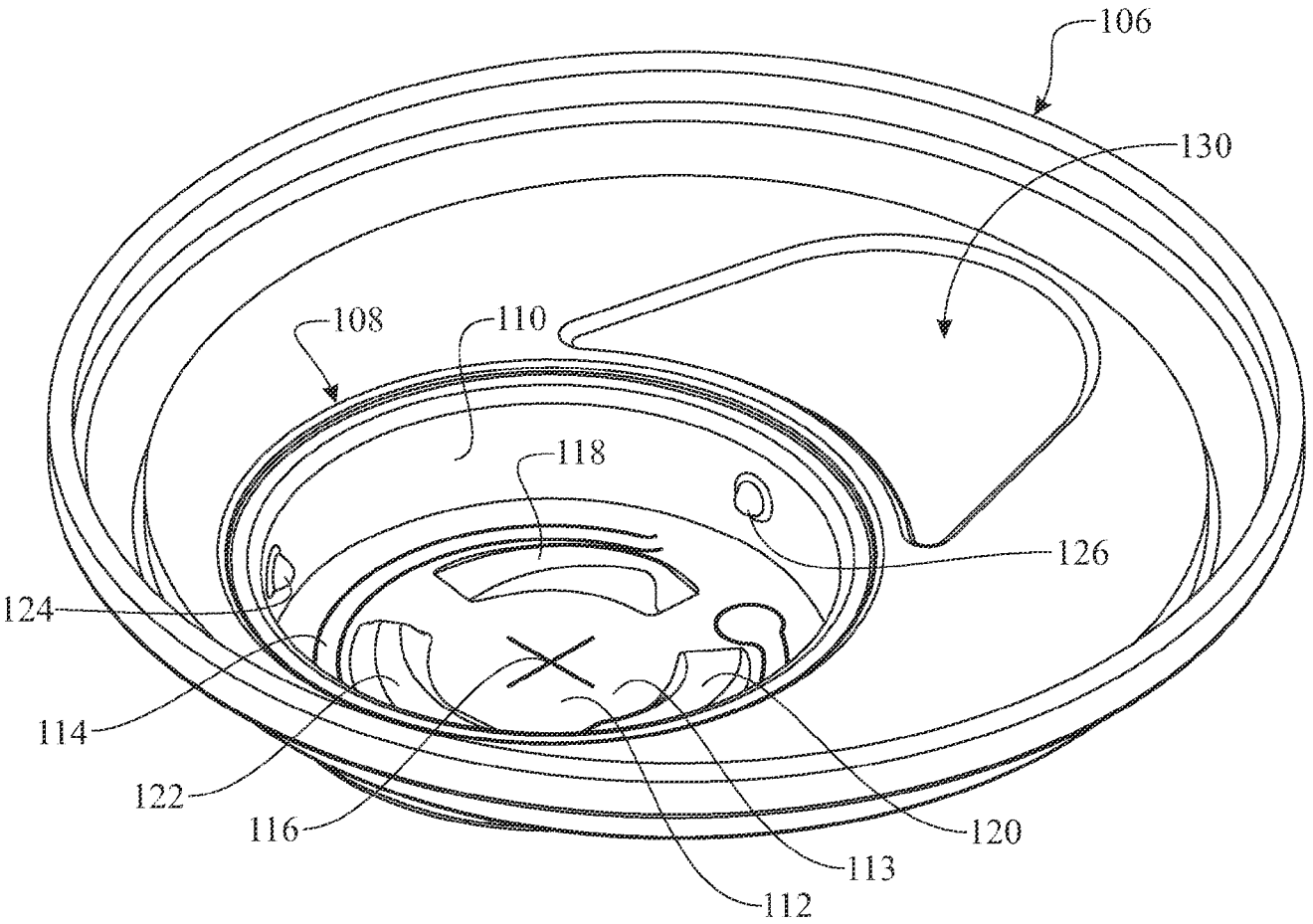
FIG. 21 is an enlarged, perspective view of the lid, without the cap, of the beverage container of FIG. 18.
Figure 22:
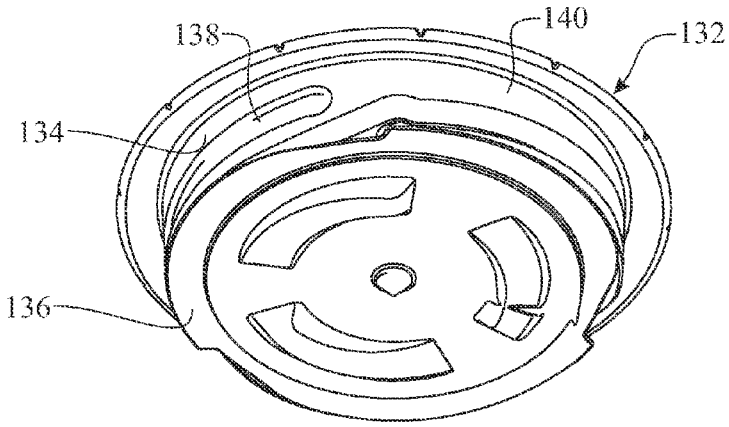
FIG. 22 is a bottom perspective view of the lid and cap of the beverage container of FIG. 18.
Figure 22:
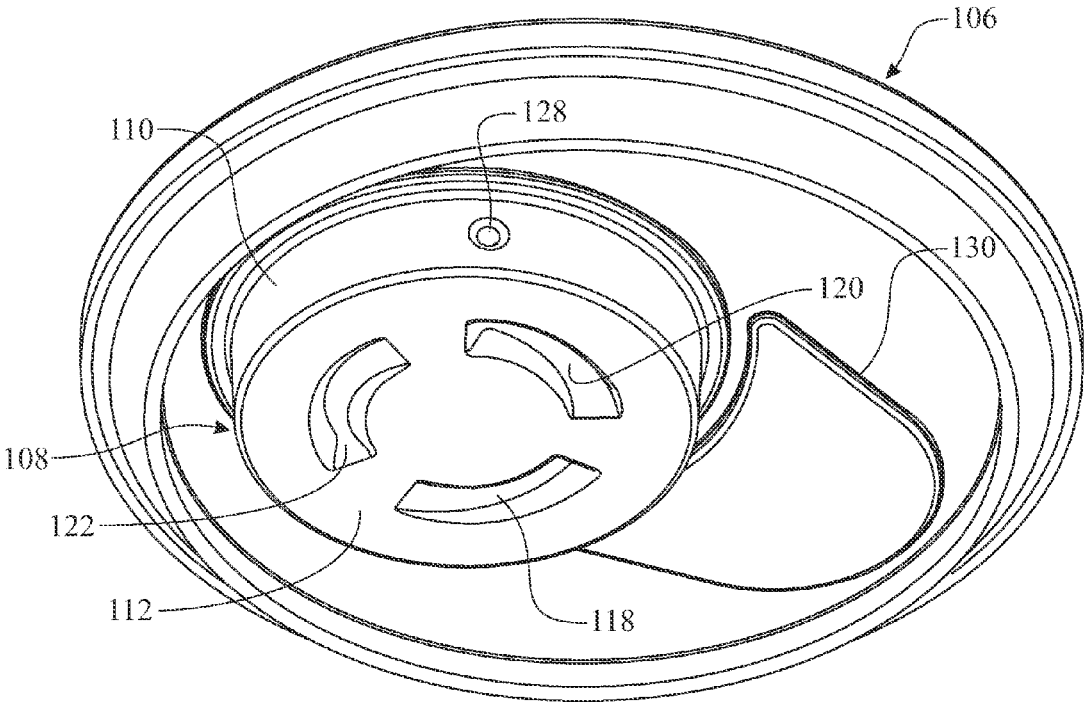
Figure 23:
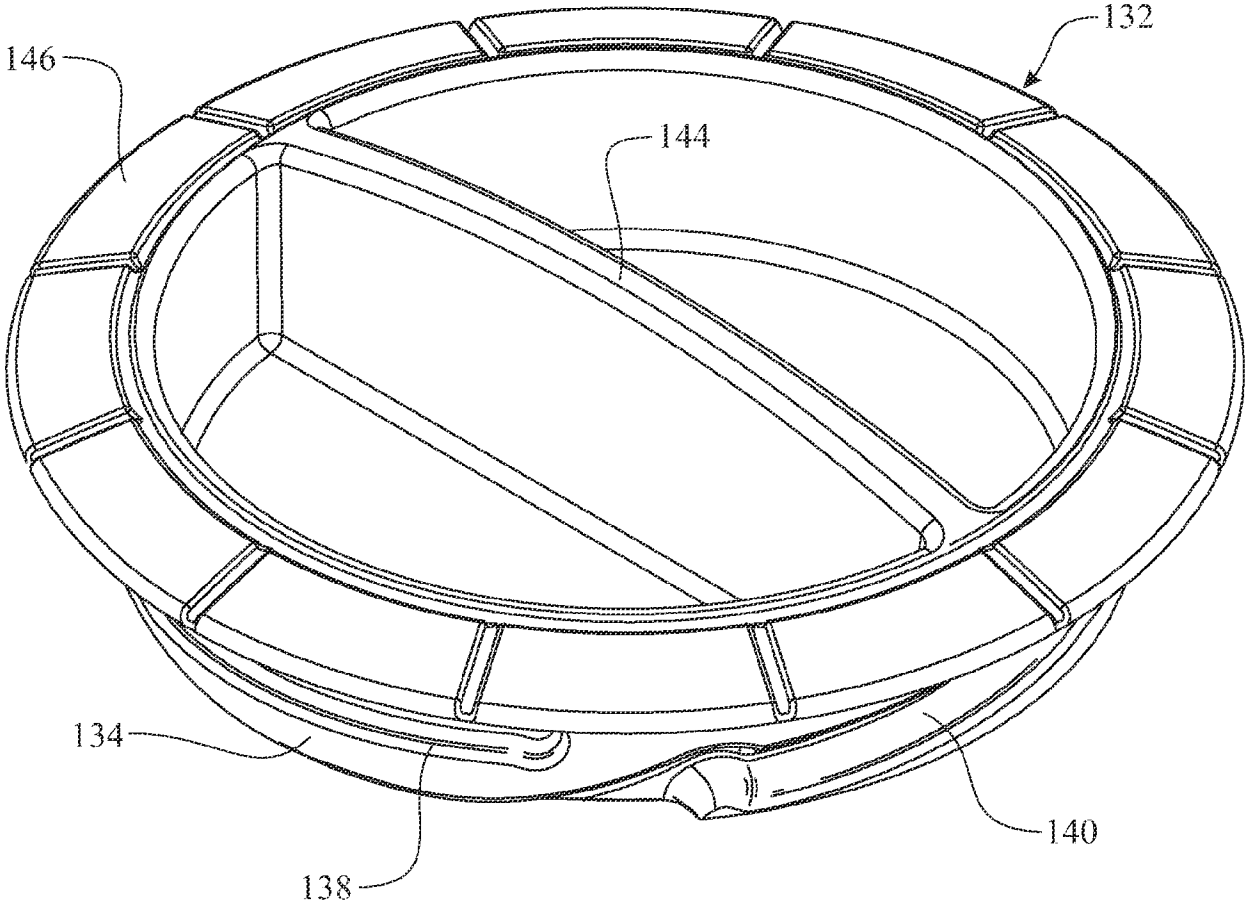
FIG. 23 is an enlarged perspective view of the cap of the beverage container of FIG. 18.
Figure 24:
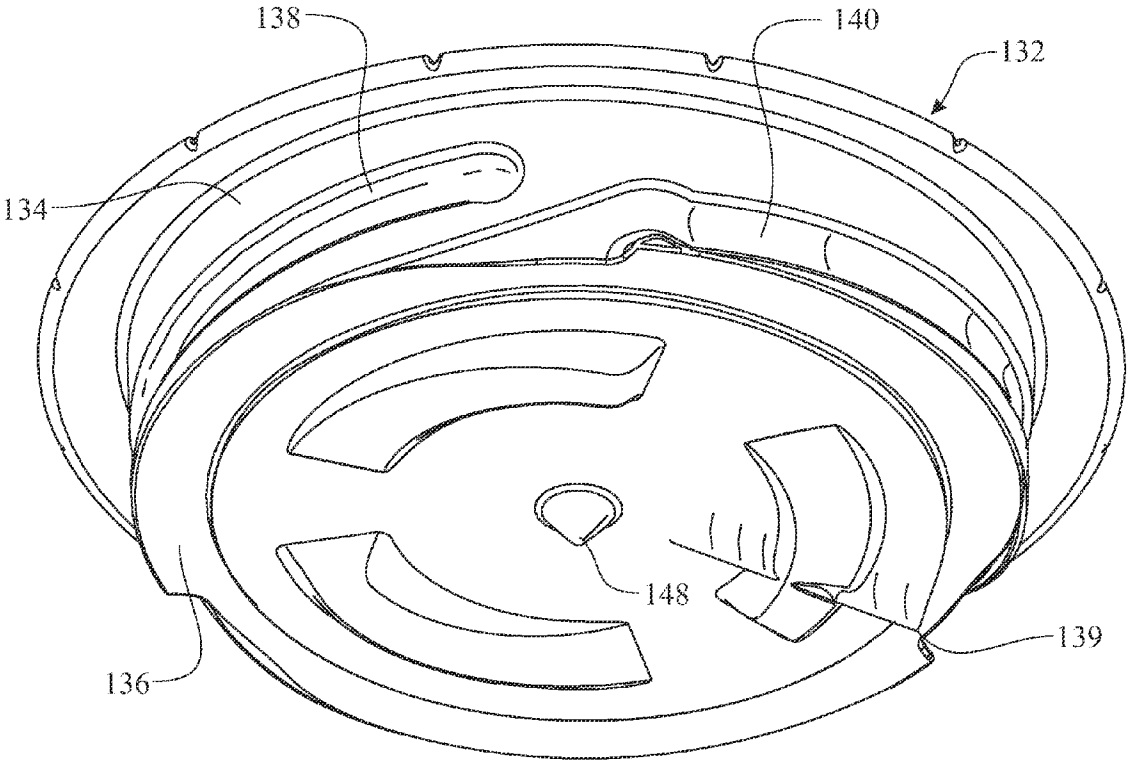
FIG. 24 is a bottom perspective view of the cap shown in FIG. 23.

Referring to FIG. 15, a further variation of manufacturing process is disclosed. In the first step a pre-formed lid is provided from a shell press with a socket already formed. In the next step, the lid and socket are aligned directionally for a conversion press. Next a score line is created in the conversion press, at the bottom of the socket. Molded caps are provided to the assembly line, and inserted into the molded cap. The molded caps are secured to the socket by forming the projections 32 in a manner described above, in which the cap functions as a mandrel during formation of the projections. Next, the lids with secured caps are packaged and shipped to bottlers or others for conventional filling, sealing, and shipment to customers. As in the previously described manufacturing process, there is no need to form a rivet in the lid, and no need to attach a pull tab to the rivet. Avoiding these steps saves money and makes the resulting product easier to recycle.

An alternative embodiment of a beverage container 100 is shown in FIGS. 18-35, and includes a body having a cylindrical sidewall 102 and opposite axial ends. The beverage container, like that of the previous embodiment, is illustrated in the size and shape of a common aluminum can used today for a wide variety of beverages, including soft drinks, juice drinks, and beer. The body itself differs from the prior art in the features at the top end of the container where the features of the present invention allow for opening and resealing the container 100.

A bottom wall 104 (seen in FIG. 20) is integrally formed at one of the axial ends with the sidewall 102 in the known fashion of making aluminum cans. However, the body can be made of other materials and have other shapes, depending on either style, functionality or a combination of both. A lid 106 is attached to the open axial end of the body, at the open end defined by the cylindrical sidewall 102, after filling the body with a beverage in the ordinary, and known, way of attaching lids or tops to cans. After assembly, the lid 106, bottom wall 104 and cylindrical sidewall 102 define a closed, interior space.

A socket 108 is formed in the lid 106 and includes a cylindrical sidewall 110 and a bottom wall 112. The socket 108 is located eccentrically so that it nears a peripheral edge of the lid 106 to facilitate drinking and pouring after opening. The socket 108 further includes a score line 114 slightly inset from the peripheral edge of the bottom wall 112 and forming a substantially closed loop frangible area 113. An additional score line 116 is provided at the center of the bottom wall bottom wall 112 and preferably includes two intersecting score lines that form an "X" with the intersection of the two lines being at the center of the bottom wall 112. The bottom wall 112 further includes three ramps 118, 120, and 122 which are equi-distantly spaced around the periphery of the bottom wall 112 inside the score line 114. A different number of ramps could be used, but three is preferable. The ramps 118, 120 and 122 are integrally formed in the bottom wall 112.

The socket 108 further includes three equi-distantly spaced projections 124, 126 and 128 formed in the sidewall 110. From an interior view, such as that shown in FIGS. 22 and 34, the projections such as projections 124 and 128 are shown as indentations, since the projections are formed from the sidewall material. The lid 106 also includes a recessed area 130, as in the previous embodiment, which may include instructional text to inform the consumer how to use the opening and resealing features of the beverage container 100.

Figure 31:
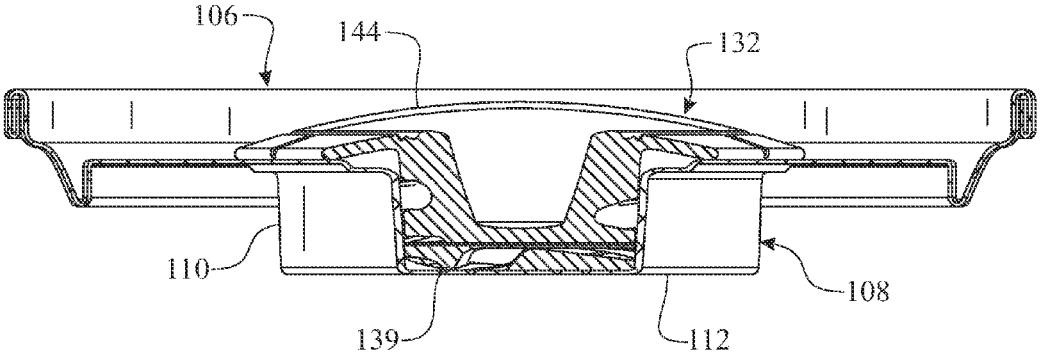
FIG. 31 is a sectional view of the cap of FIG. 18, taken along line II-II of FIG. 29.
Figure 32:
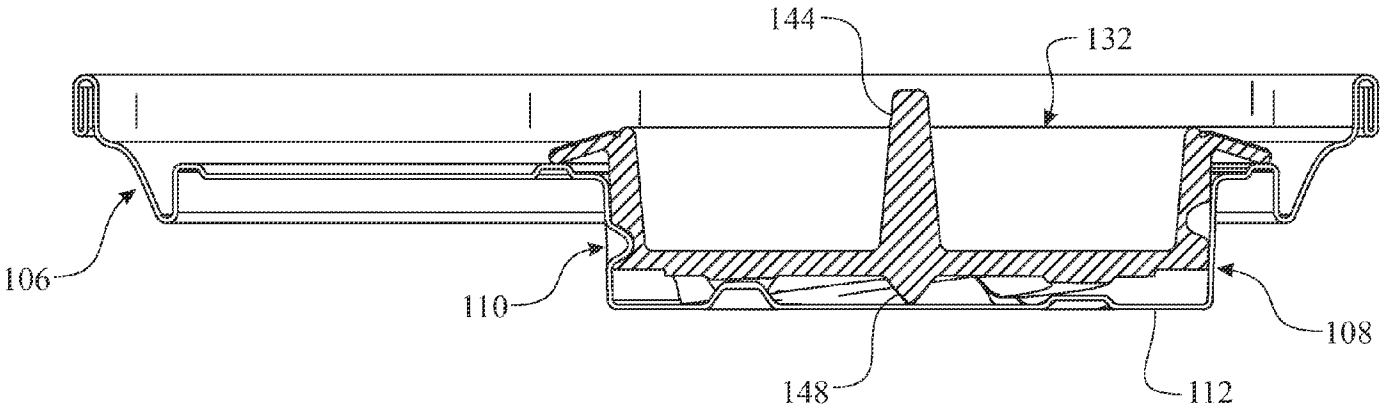
FIG. 32 is a sectional view of the cap of FIG. 19, similar to FIG. 30 but shown in side elevation, and taken along line I-I of FIG. 29.
Figure 33:
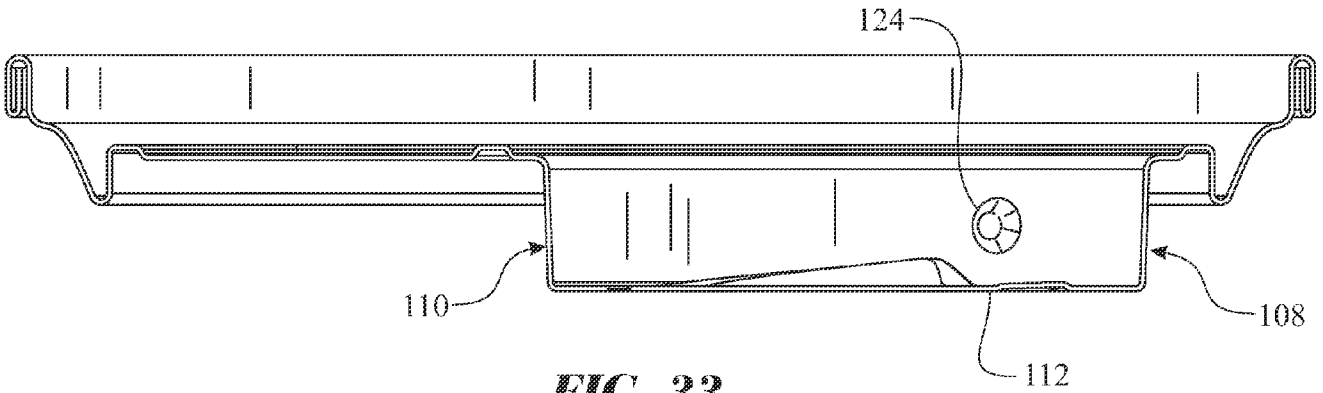
FIG. 33 is a sectional view similar to FIG. 30, but with the cap removed.
Figure 34:
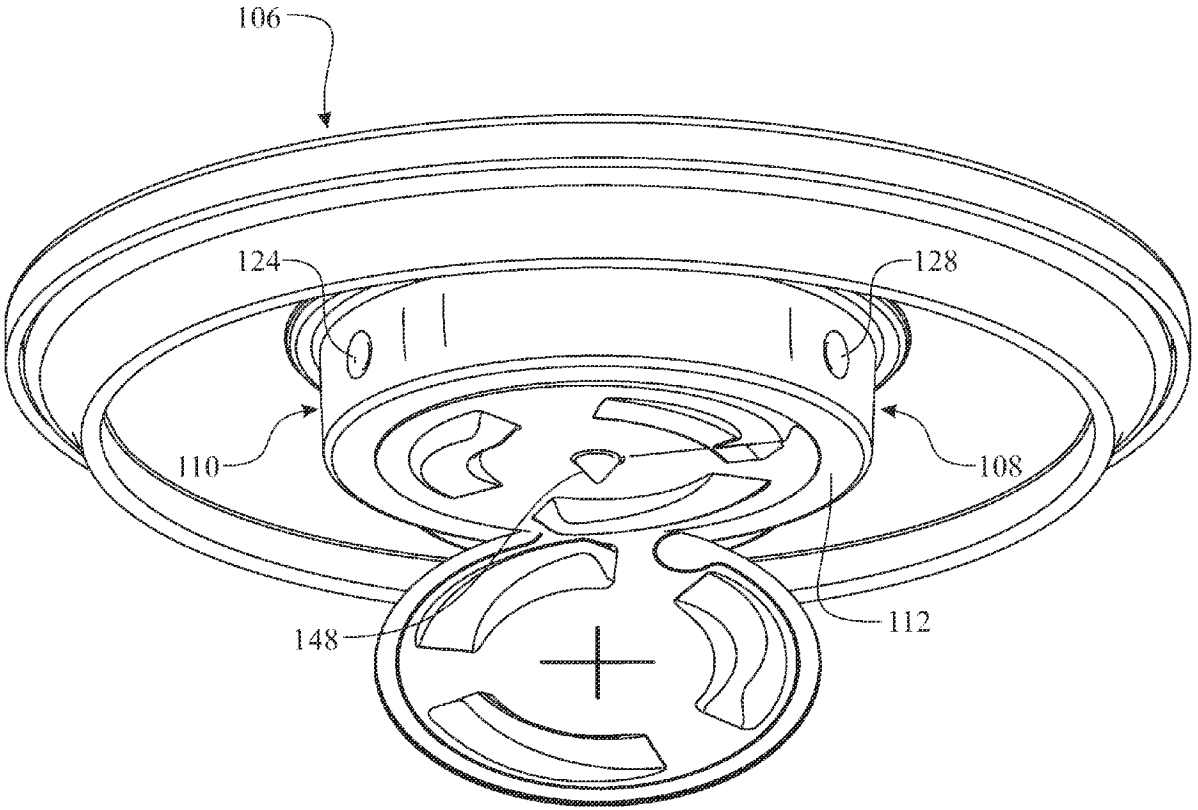
FIG. 34 is a bottom perspective view of the lid and cap subassembly, showing the opening of the beverage container after the cap has been rotated to impart linear motion that pushes the frangible portion of the lid into the beverage container.

A cap 132 fits into the socket 108 and includes a cylindrical sidewall 134 and a bottom wall 136. A series of spiral grooves 138, 140 and 142 are provided in the sidewall 134 of the cap 132 at equi-distantly spaced locations and are designed to receive the projections 124, 126 and 128, respectively, of the socket 108, when the cap 132 is assembled within the socket 108. In this regard, the embodiment of beverage container 100 is similar to that of the embodiment of beverage container 10. When assembled and before opening the container, the cap seats in the socket 108 as shown in FIGS. 30-32.

The cap 132 further includes a handle or grip 144 at the upper end of the cap 132 so that the consumer can turn the cap in either clockwise or counterclockwise directions. As in the previous embodiments, the upper perimeter of the cap is provided with a frangible skirt 146 which provides a tamper resistant element, whereby the skirt would extend upwardly if the cap had been turned to cause the cap 132 to descend further into the socket 108. The skirt 146, and all other features of the cap 132 are integrally formed in a one-piece construction preferably of a plastic material. Within the scope of the invention, other materials could be used including ceramic and metallic materials.

A central sharp projection 148 is formed in the center of the bottom surface of the cap 132, so that when the cap 132 is fitted in the socket 108, prior to opening the beverage can 100, the point of the sharp projection 148 is positioned next to or juxtaposed at the center of the bottom surface of the socket 108, at the point of intersection between the two lines that form the score line 116. The sharp projection 148 punctures the bottom wall 112 of the socket 108 as the cap 132 moves linearly downwardly and further into the socket 108 during opening operation of the beverage can 100.

Figure 30:
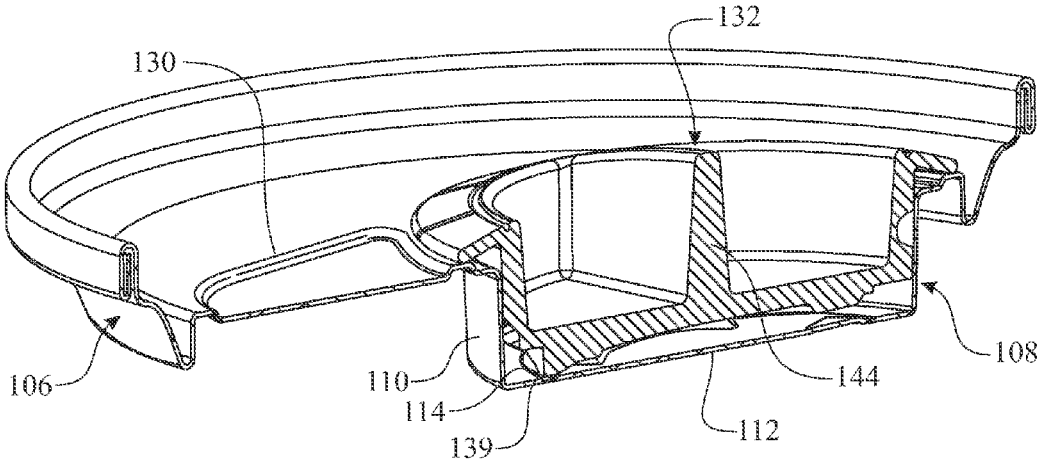
FIG. 30 is a perspective, sectional view of the cap of the embodiment of FIG. 18, taken along line I-I of FIG. 29.

An outer sharp projection 139 is formed along an outer region of the bottom surface of the cap 132, so that when the cap 132 is fitted in the socket 108, prior to opening the beverage can 100, the point of the sharp projection 139 is positioned in alignment with the score line 114 formed in the bottom surface of the socket 108, as best shown in FIG. 30. The sharp projection 139 fractures the score line 114 formed in the bottom wall 112 of the socket 108 as the cap 132 moves linearly downwardly and further into the socket 108 during opening operation of the beverage can 100.

Figure 25:
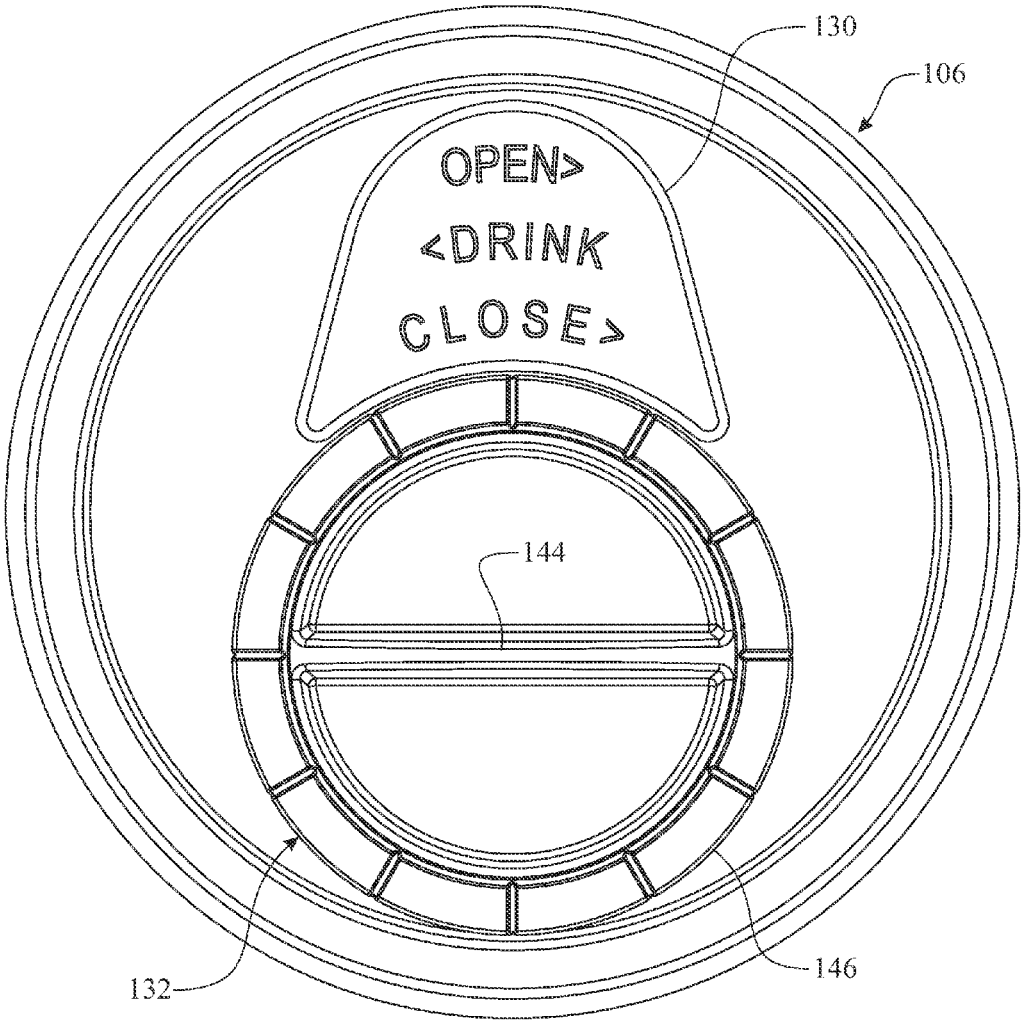
FIG. 25 is a top view of the lid and cap assembly of the beverage container of FIG. 18.
Figure 26:
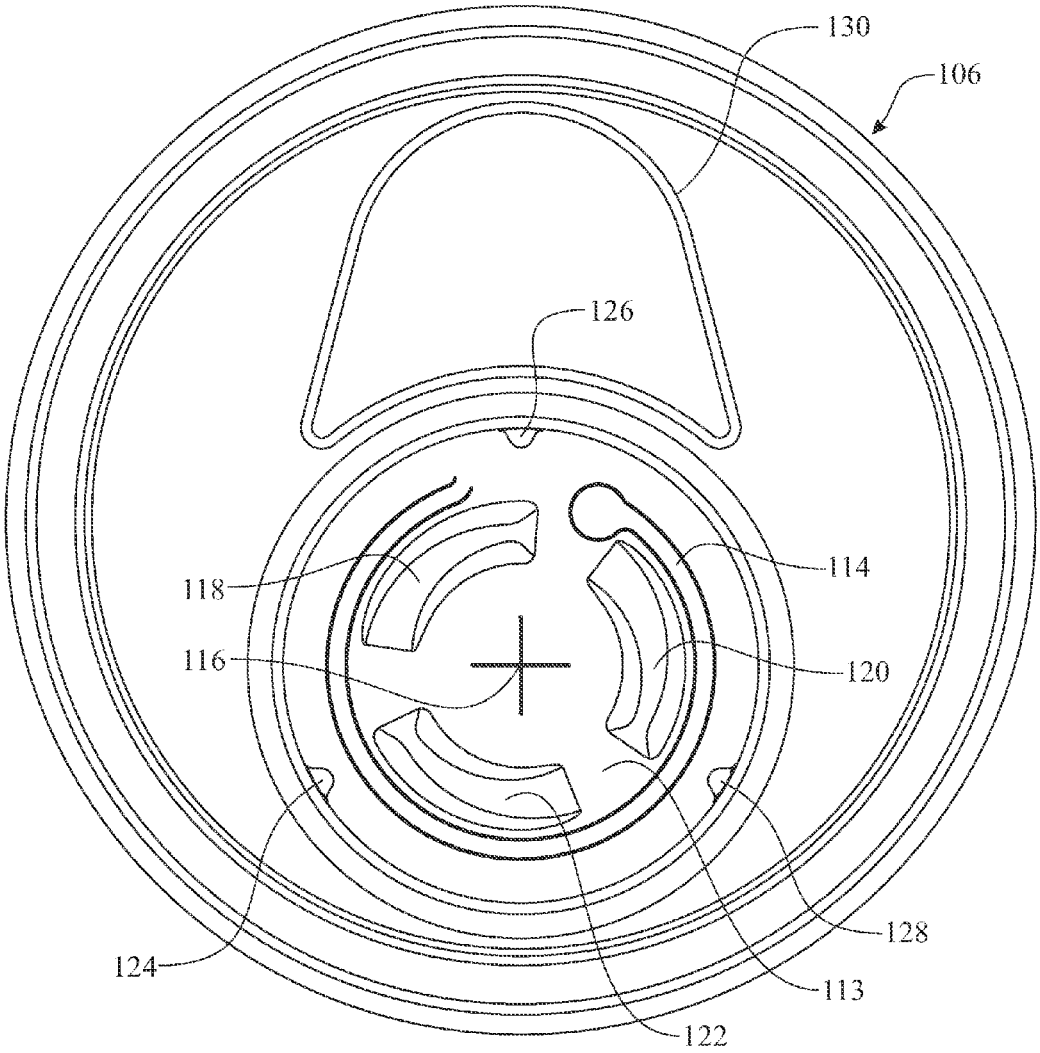
FIG. 26 is a top view of the lid of FIG. 25, with the cap removed to show details of the socket.
Figure 27:
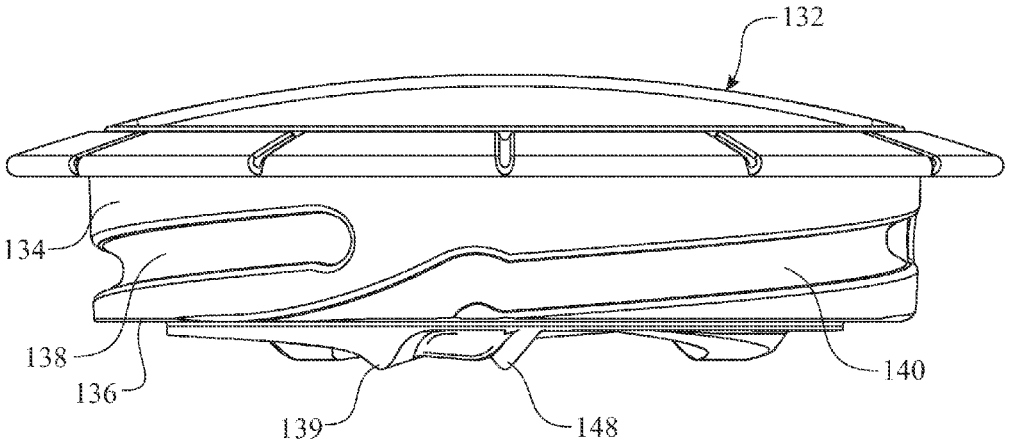
FIG. 27 is a side elevational view of the cap of FIG. 18.
Figure 28:
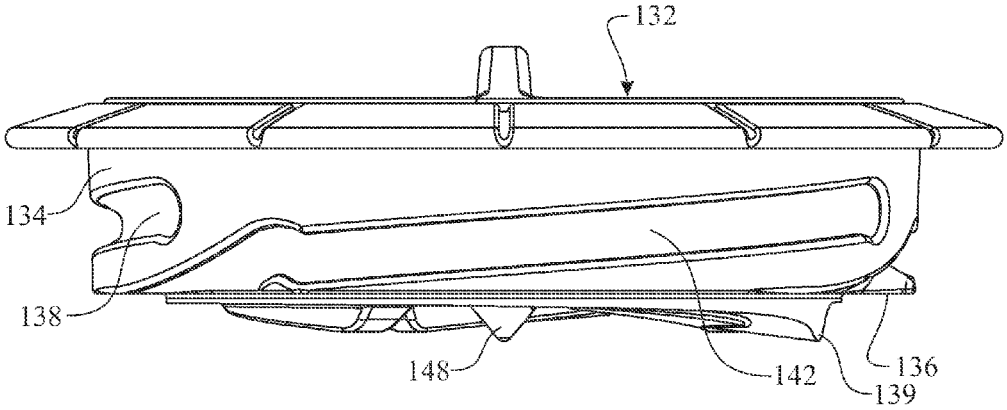
FIG. 28 is a side elevational view of the cap of FIG. 27, rotated 90 degrees.
Figure 29:
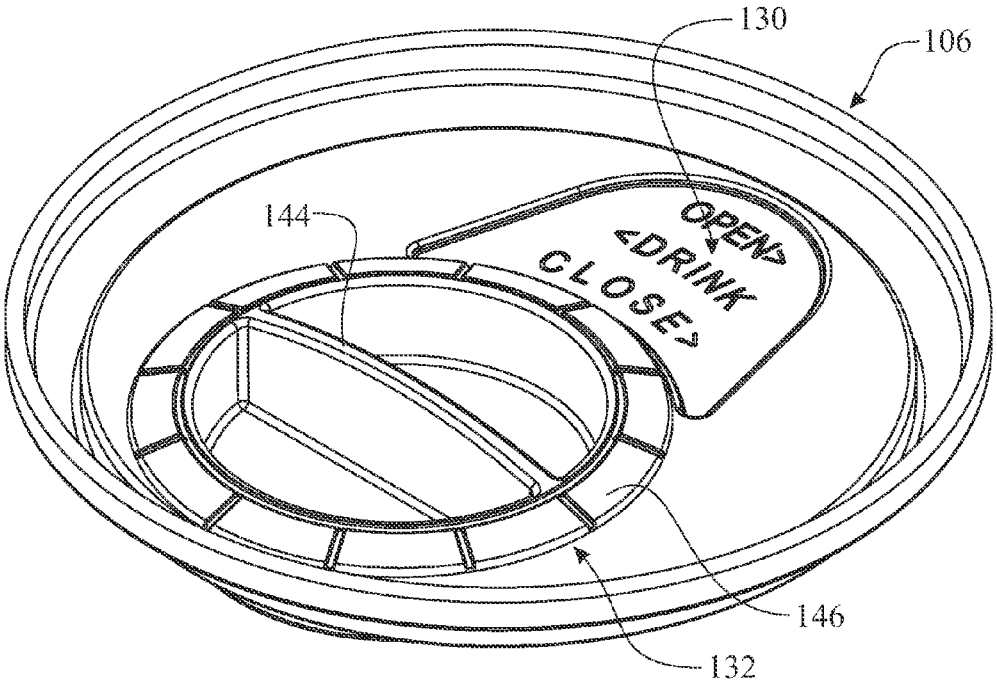
FIG. 29 is a perspective view of the cap and lid subassembly of the embodiment of FIG. 18.

To understand how the embodiment of beverage container 100 operates, reference is made to FIG. 25, which is a top view of the beverage container prior to opening. Optionally, the recessed area 130 is embossed, printed or otherwise marked with instructions for how to use the cap 132. First, the consumer is instructed to open the beverage container by turning, or rotating, the cap 132 in the clockwise direction. The degree of slope on the ramps and the degree of slope on the spiral grooves is selected to ensure that the beverage container 100 can be opened with the same or similar amount of force used to open a conventional beverage container, such as a soda can. This can be accomplished with a turning motion of the cap that is in the range of 45 to 90 degrees, preferably.

After the cap is rotated or turned to the full extent allowed, the cap pushes the tear panel 113 into the can, but the tear panel 113 stays connected to the lid through a portion of the lid between the ends of the score line 114. In order to then drink the contents of the beverage container 100, the consumer turns, twists or rotates the cap 132 in the opposite direction until returning past the starting point from where the opening rotation started, placing the projections 124, 126 and 128 in the opened area of the spiral grooves 138, 140 and 142.

At that point, the cap 132 is pulled upwardly by the consumer to become separated from the beverage container 100, and the consumer is then free to drink from the opening formed in the lid 106 as a result of the frangible area being pushed into the container 100. When the consumer is finished drinking, and if the beverage container 100 is not empty, the consumer can reseal or close the beverage container by pushing the cap 132 back into the socket 108 and then turning, twisting or rotating the cap 132 in the same direction as the opening direction, until the cap 132 is fully seated in the socket 108, thus sealing the opening in the beverage container 100. In the resealed state, the contents of the beverage container 100 can be kept fresh, carbonated (in the case of carbonated drinks), and spill-proof (when the beverage container is mobile, such as if kept in a back pack, stroller, automobile drink holder, etc.).

As in the other embodiments described herein, the invention includes an assembled beverage container, with or without contents, with a unique resealing mechanism. The invention also includes a beverage container subassembly comprising a lid and resealable cap, capable of further assembly with a beverage container body, such as those commonly in use as aluminum cans for a wide variety of beverages. The invention further includes a cap capable of use with a lid, or with a beverage container that includes a lid, such that the beverage containers could be purchased without caps, and could separately purchase caps that are then used with the beverage containers that are formed with the aforementioned socket. This way, caps could be re-used, repeatedly. Purchase of caps separately from the beverage containers would have a "green" effect, in that the caps could be washed and re-used over and over, thereby reducing waste.

Figure 36:
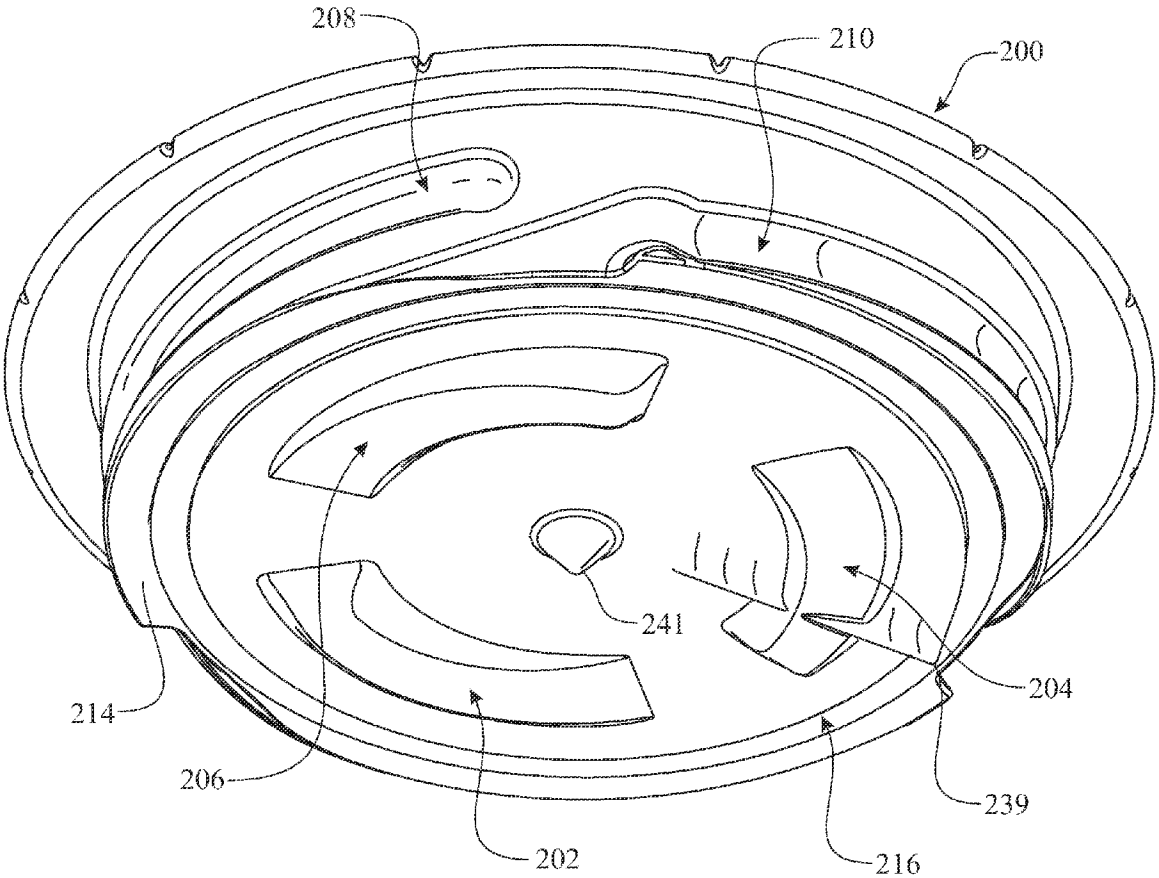
FIG. 36 is a bottom elevational view of a cap, similar in all aspects to the previously illustrated caps, but including a soft plastic sealing ring to further enhance the sealing capabilities of the cap.
Figure 37:
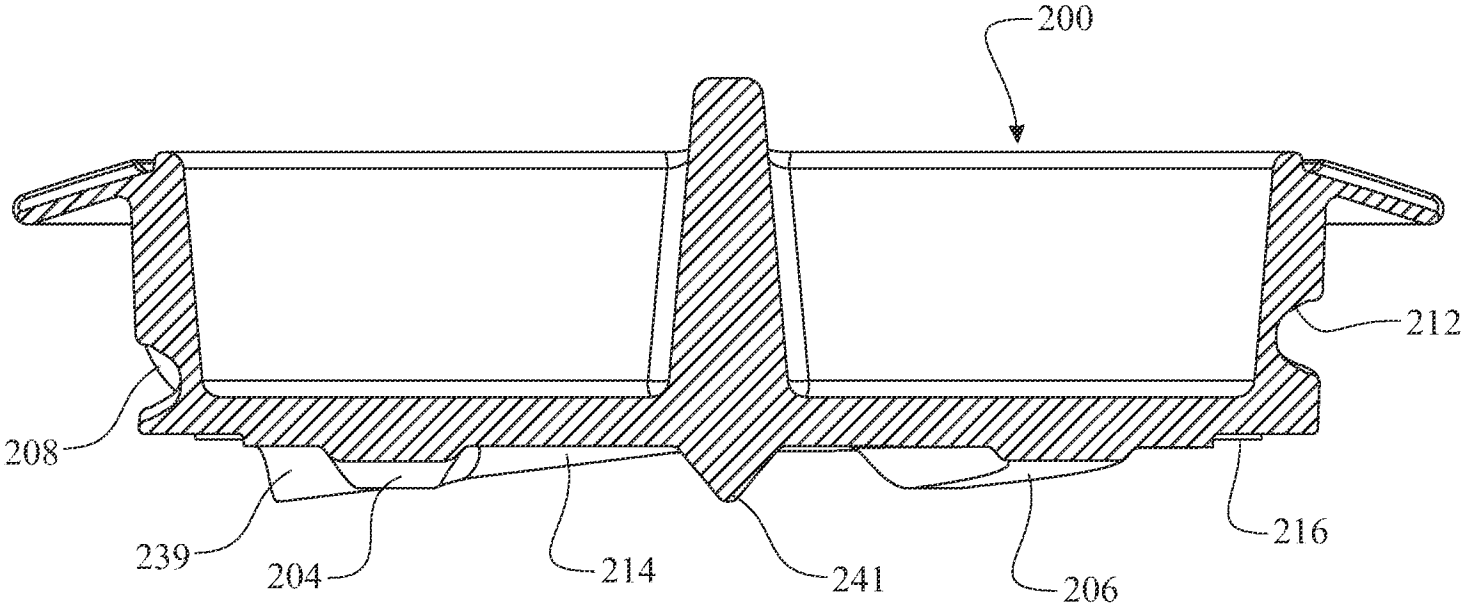
FIG. 37 is a cross sectional view of the cap of FIG. 36.

Referring to FIGS. 36 and 37, another feature of the invention is to provide a cap 200 which has the features presented above, including the ramps 202, 204 and 206, and grooves 208, 210 and 212. As with the other embodiments, the cap 200 has an end face or bottom wall 214 from which the ramps project. A sealing ring 216 is provided on the surface of the end face 214 near the periphery thereof. The sealing ring is 216 is made of an elastomeric material that is different from the material that constitutes the cap 200, which is preferably made of a hard plastic material. The material which forms the sealing ring 216 can be injected through ports into a mold and formed on the cap 200 at the same time that the cap 200 is being injection molded. Alternatively, the sealing ring 216 can be a separate pre-formed item that can be adhesively bonded in place after the cap 200 is removed from its mold.

A central sharp projection 241 is formed is formed in the center of the bottom surface of the cap 200, wherein the central sharp projection 241 is similar to the central sharp projection 148 described above in design, location and function.

An outer sharp projection 239 is formed along an outer region of the bottom surface of the cap 200, wherein the outer sharp projection 239 is similar to the outer sharp projection 139 described above in design, location and function.

Any of a variety of thermoplastic elastomers (TPEs) can be used to make the sealing ring 216, and selection of the precise one is a matter of design choice, as the requirements are simply that the material be easy to mold, easily adherent to the material that makes up the cap, and to some degree deformable under pressure (in use). Other materials could be used if a sealing ring is pre-made and adhesively bonded to the end face or bottom wall of the cap. However, molding the ring in place is preferred. As for TPEs, they are sometimes referred to as thermoplastic rubbers, and are in a class of copolymers or a mixture of polymers which consist of both thermoplastic and elastomeric properties. They are particularly suitable for injection molding, which is the preferred way to form the sealing ring 216 on the face of the cap.

Figure 38:
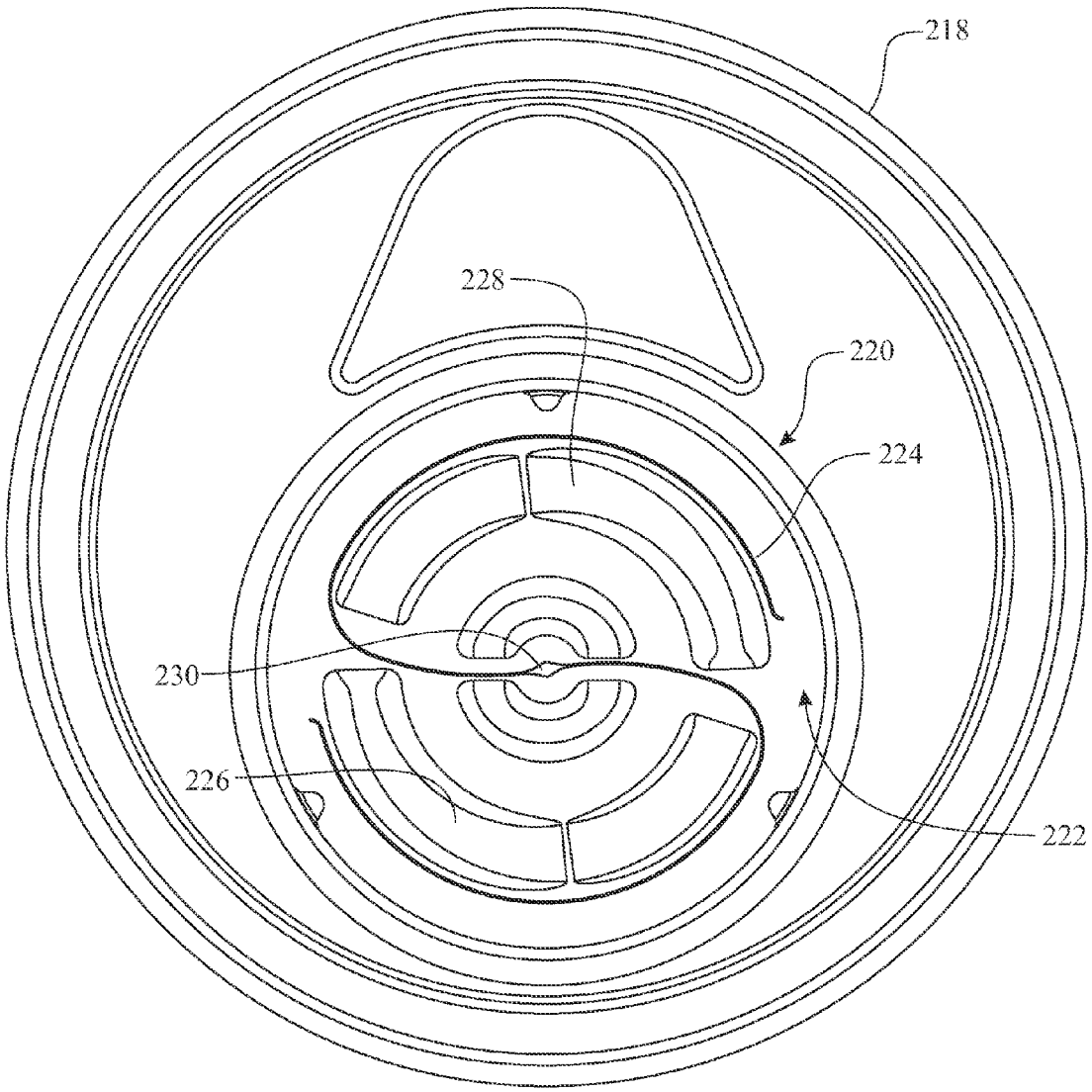
FIG. 38 is a top view of a beverage container lid, showing another embodiment of score line used to create two tear panels during the opening process.

It is noted that in FIG. 38, there are two ramps illustrated as opposed to three, which are found in the other embodiments. Essentially any number of ramps can be employed, but two or three are more preferred for reasons that two or three can generate an opening force without requiring too much torque, and they are easier to manufacture than a number greater than three. As seen in FIG. 38, a cap used in the embodiment of FIG. 38 has two ramps on the lower end face that are shaped and positioned compatibly with the ramps 226 and 228 shown in FIG. 38.

Figure 35:
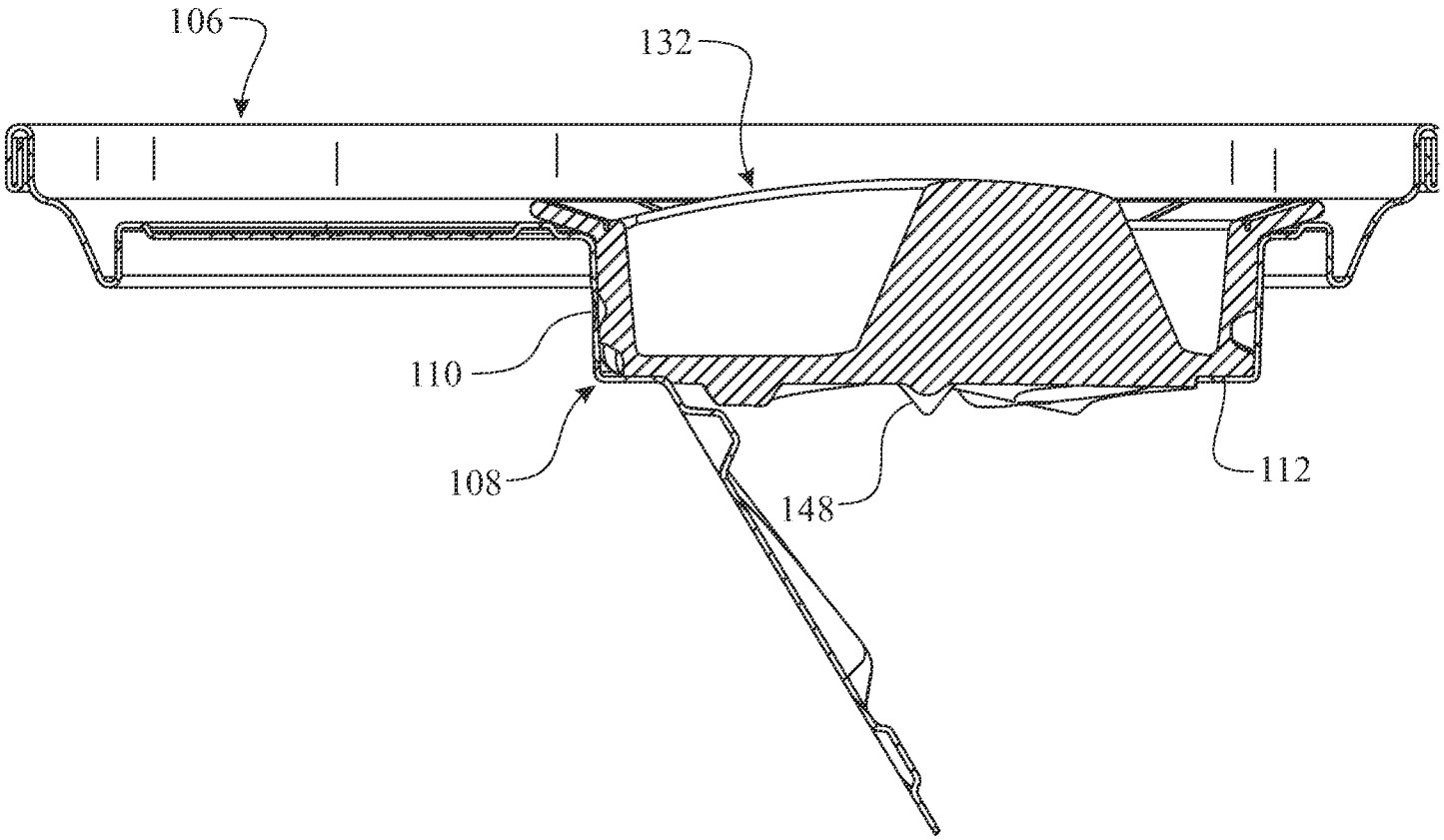
FIG. 35 is a sectional view of the lid and cap subassembly, taken along line of FIG. 34.

The cap 200 operates in the same way as the caps of previous embodiments, in that the consumer turns the cap in one direction to open the container, then turns the cap in the opposite direction to remove the cap, and then the cap is re-inserted into the socket and turned in the first, container-opening direction until the cap is fully seated in the socket. FIG. 35 shows how the cap 132 is in this fully seated position, for resealing the container, in which the bottom wall 136 of the cap 132 presses against the bottom wall 112 of the socket 108 to form a sealing engagement between the socket and the cap. With the embodiment of cap 200 that includes the sealing ring, in this position, the sealing ring 216 is pressed against the bottom wall 112 of the socket to enhance the sealing relationship between the socket and the cap. Contact between a hard surface, i.e., the metal material that makes up the socket 108, and a relatively softer material, i.e., the elastomeric material that makes up the sealing ring 216, will ensure a better seal for the contents of the beverage container. This is particularly useful when it comes to carbonated beverages, such as sodas and beers.

Figure 39:
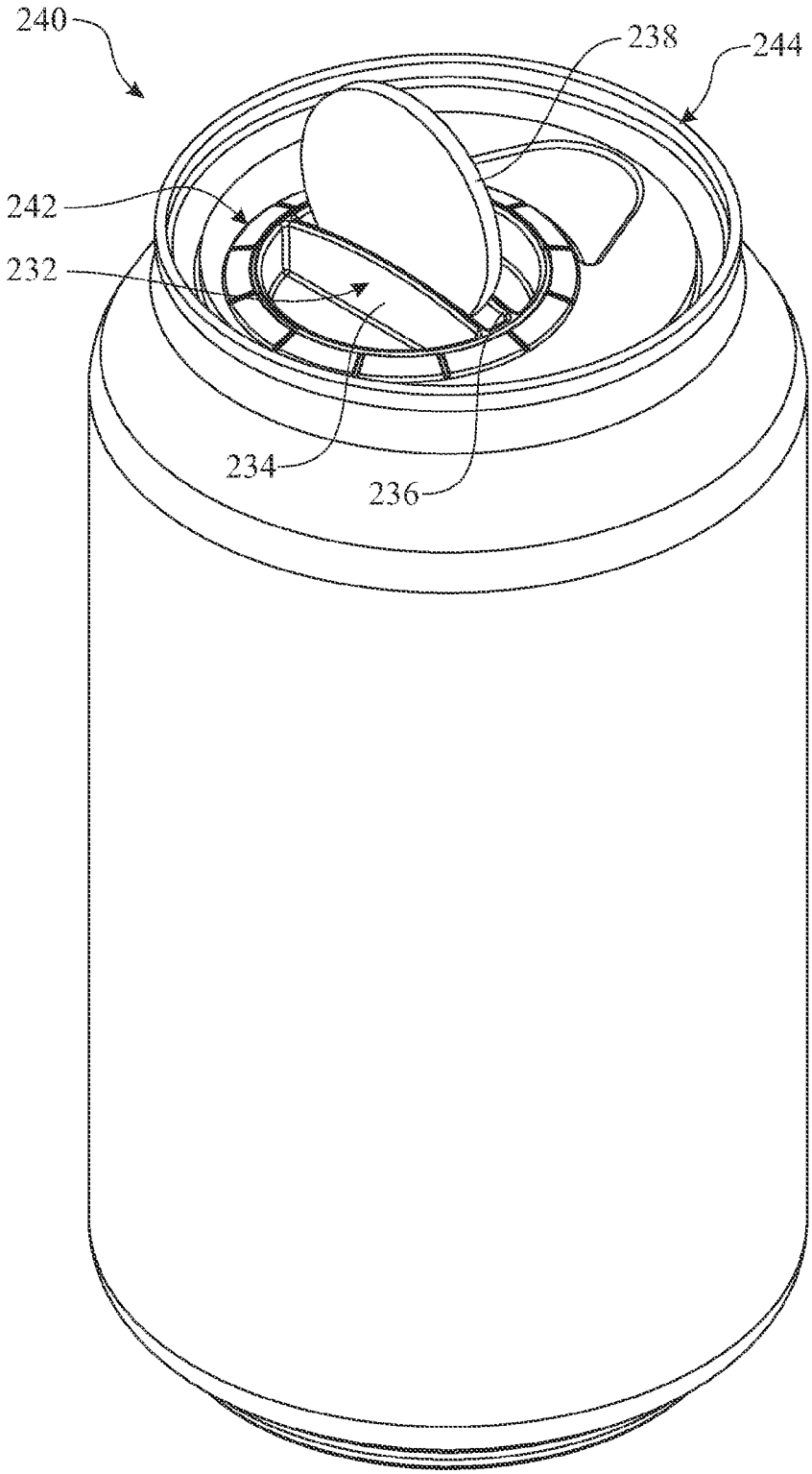
FIG. 39 is a side elevational and perspective view, showing a grip capable of using a coin or other implement to provide greater opening force by the consumer.
Figure 40:
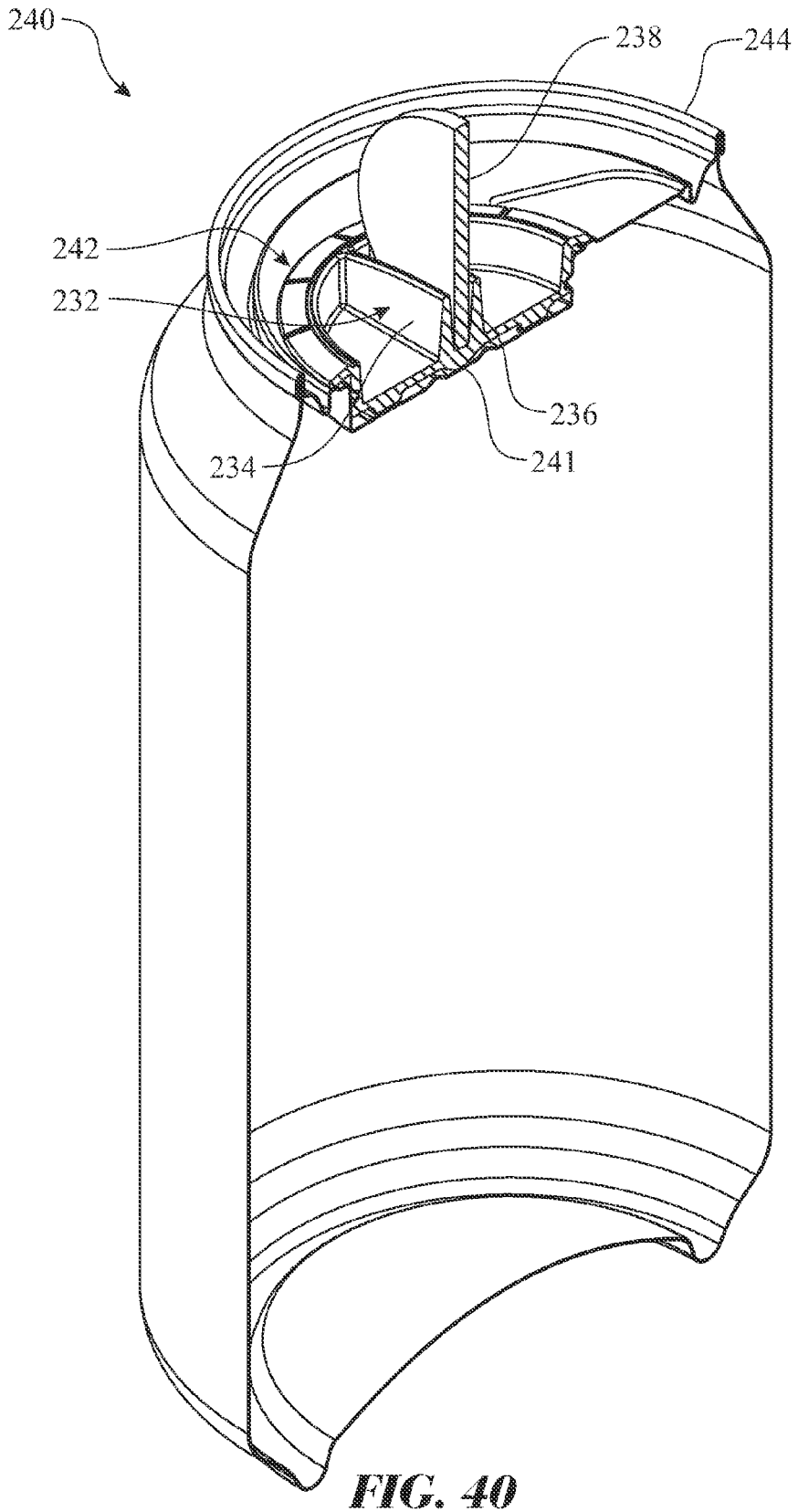
FIG. 40 is a side elevational and perspective view, partly in section, showing a grip capable of using a coin or other implement to provide greater opening force by the consumer.

In the previously described embodiments, the cap is provided with a handle or grip 48, as seen in FIGS. 10, 11 and 13*a*, for example. An alternative embodiment of a grip 232 is shown in FIGS. 39 and 40, in which the grip 232 includes two parallel cross bars 234 and 236, spaced apart by an amount sufficient to fit a force enhancing, or grip enhancing element, such as a coin 238 or other object made of material rigid and strong enough to transfer torque from the consumer's hand to the cap. Obviously, the larger the diameter of the coin or other object, the more force that can be transmitted to the cap. The beverage container 240 can be sold as an assembly which includes the cap 242 and the implement 238 (assuming it is not a coin), a subassembly including the lid 244, cap 242 and implement 238 (without the container body and sealed contents), or the cap 242 can be sold by itself. For ease of storage and transportation, and as a cost saving, it is preferable not to sell or package an implement 238 with the beverage container 240 or cap 242, and/or lid/cap assembly.

Figure 41:
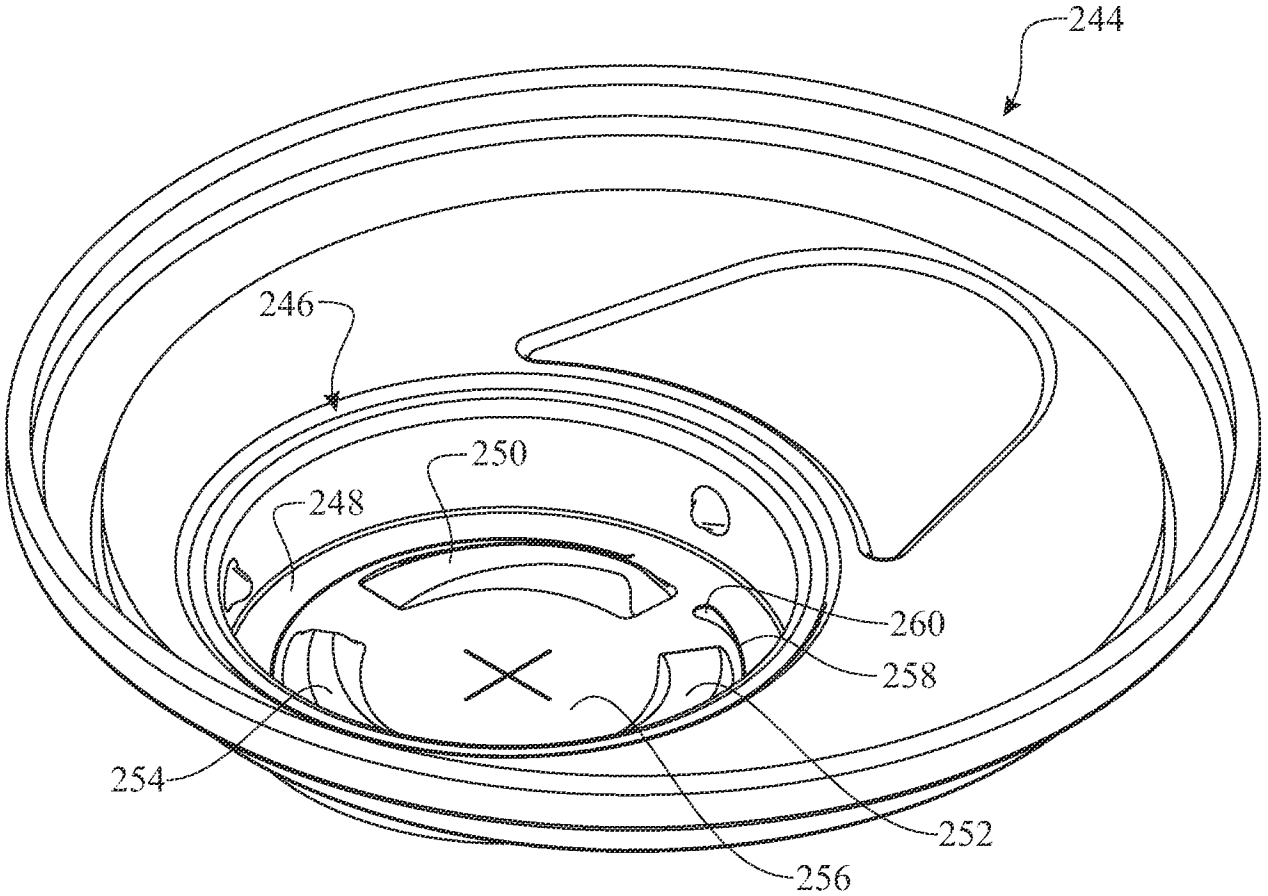
FIG. 41 is a top perspective view of a beverage container lid with a score line having means for enhancing the fracture of the score line.

Referring now to FIG. 41, another aspect of the invention includes making the score line which defines the tear panel or panels in a way that enhances the opening or fracturing ability of the score line. As seen in FIG. 41, a lid 244 includes a socket 246 which includes a bottom wall 248. The bottom wall 248 includes three ramps 250, 252 and 254, and a frangible area 256 defined by a score line 258. The score line 258, as in one of the previous embodiments, is in the form of a loop, not quite fully disposed, so that a hinge is defined between the opposite ends of the score line. The score line 258 is made during the formation steps that create the lid 244, which in the case of beverage cans, is made of 0.008 inch thick material. The score line is typically 0.004 inch deep, so that the thickness of the lid under the score line is typically about 0.004 inch thick for aluminum beverage cans. The thinning of the material occurs during pressing of the lid, and in essence, the material which comprises the lid is deformed and flows to create a thinned area beneath the line.

Using the same principals of material flow or deformation during the pressing steps, a puncture area 260 is formed at one end of the score line 258 where one of the ramps will impinge upon the score line. At the beginning of the opening process, the ramps push on the flared, puncture area 260, which has been thinned essentially to the thickness of the sidewall of the beverage container, in the case of an aluminum can. In other words, the entire area of the puncture area is thinned relative to the surrounding surface of the lid to make it easier to puncture or break the score line. Once the score line is broken at the puncture area, the break will propagate more readily and predictably around the score line to ease the opening of the beverage container. Although the puncture area 260 is thinner, and thus potentially more vulnerable to accidental opening, it is no thinner than the sidewall of the beverage container and thus capable of withstanding internal pressures. It is also shielded from accidental external rupture by means of the cap when seated in the socket.

Each embodiment described herein has referred to a tear panel, such as tear panel 25, as that part of the bottom wall of the socket that is defined by a circular or loop-shaped score line. This tear panel has also been described as a "frangible area" because it breaks away from the rest of the bottom wall when the cap descends into the socket. It is not required, however, for the tear panel or frangible area to be substantially circular or looped in shape, and indeed, a second illustrated embodiment is shown in FIG. 38. While all other aspects of the beverage lid 218 are the same as in previous embodiments, including a socket 220 having a bottom wall 222, the bottom wall is provided with an "S" shaped score line 224 which, when fractured by operation of the down movement of the cap and engagement of ramps 226 and 228, the fracture forms two separate tear panels which are pushed inwardly during the opening operation, with the two tear panels being connected to the can by a hinge area on opposite sides of the bottom wall 222. During the opening process, the sharp protrusion in the middle of the bottom wall of the cap will puncture the center of the score line at a thinned area 230. At about the same time, the ramps of the socket and cap cooperate to push the frangible areas at locations opposite what will become the hinges, in essentially the "loop" portions of the S shaped score line. Simultaneously, two tear panels are formed and pushed into the beverage container.

During opening and closing operations, the handle or grip is turned preferably 90 degrees in one direction, and then to withdraw the cap from the socket, the grip is turned 90 degrees in the opposite direction, to the beginning point. In order to remove the cap altogether from the lid, the grip is turned approximately another 10 degrees until the grooves and protrusions are separated and the cap is free to be lifted upwardly away from the container. Different combinations of embossed ramps and de-bossed ramps, and different numbers of ramps, can be employed to achieve the desired effect. The space between the cap and the bottom wall of the socket is equal to the length of linear travel when the cap is operated between the transport and open/resealed positions (in the case of aluminum beverage cans, approximately 0.055 inches). With the use of ramps that are embossed on the tear panel that distance can be doubled, forcing the tear panel to fold on its hinge further away from the opening.

In all cases using ramps, it is preferred that the peak height of the ramps be disposed near or in close proximity to the hinge, as this will help push the tear panel out of the way when the cap's cam body pushes through the opening. The ramps help propagate the ruptured score along its length. There are corresponding ramps or other structures on the bottom of the cap that will interface with ramps on the tear panel or panels. All ramps are embossed (rise up from the bottom socket surface), but they could equally be de-bossed ramps that start below the bottom socket surface and continue up the embossed ramp. If the respective ramp on the cap starts inside the debossed ramp on the lid, during operation the effective linear travel of the cap can be doubled, tripled, and perhaps quadrupled.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A beverage container comprising:

a container body having:

a container sidewall defining a tubular section extending between a container sidewall top edge and a container sidewall bottom end, a container bottom wall providing a seal across the container sidewall bottom end, and a container opening defined by the container sidewall top edge;

a lid connected to the container sidewall top edge to define a closed, interior space, the lid having a score line, the score line defining a tear panel;

a cap rotatably and detachably connected to the lid in juxtaposition to the tear panel;

first drive system for driving the cap into operable engagement with the tear panel, thereby pushing the tear panel into the can to form an opening in the lid; and second drive system, operable in response to the first drive system, to increase the engagement between the cap and the tear panel, wherein the cap includes a sharp projection formed in a center of the bottom wall of the cap, and the socket includes a score line formed in a center of the bottom wall of the socket, in juxtaposition to the sharp projection when the cap is positioned in the socket.

2. The beverage container of claim 1, wherein the lid includes a socket extending downwardly into the interior space and having a sidewall and a bottom wall, and wherein the cap includes a sidewall and a bottom wall, and wherein the cap fits in the socket.

3. The beverage container of claim 1, wherein the first drive means includes a first linear motion drive mechanism, capable of converting rotational motion of the cap into linear motion of the cap.

4. The beverage container of claim 3, wherein the second drive means includes a second linear motion drive mechanism, capable of converting rotational motion of the cap into a separation force applied upon the tear panel.

5. The beverage container of claim 4, wherein the second linear motion drive mechanism includes third and fourth cam structures, formed respectively on the cap bottom wall and the socket bottom wall.

6. The beverage container of claim 5, wherein the third cam structure includes at least one cap ramp and the fourth cam structure includes at least one socket ramp in sliding engagement with the at least one cap ramp.

7. The beverage container of claim 6, wherein the at least one cap ramp includes three ramps arranged peripherally around the cap bottom wall, in sliding engagement with the at least one socket ramp.

8. The beverage container of claim 3, wherein the first linear motion drive mechanism includes first and second cam structures, formed respectively on the cap cylindrical sidewall and socket cylindrical sidewall of.

9. The beverage container of claim 8, wherein the first cam structure includes a groove formed in the cap cylindrical sidewall, and the second cam structure includes at least one projection formed on the socket cylindrical sidewall.

10. The beverage container of claim 1, wherein the score line includes at least two intersecting lines, and wherein the sharp projection is juxtaposed at the intersection between the two lines.

11. A beverage container comprising:

a container body having:

a container sidewall defining a tubular section extending between a container sidewall top edge and a container sidewall bottom end, a container bottom wall providing a seal across the container sidewall bottom end, and a container opening defined by the container sidewall top edge;

a lid disposed over the container opening and closing the body to define an interior space;

a socket formed in the lid, the socket comprising a socket cylindrical sidewall and a socket bottom wall extending across a lower end of the socket cylindrical sidewall;

a score line disposed in the bottom wall of the socket and defining a tear panel;

a cap comprising a cap cylindrical sidewall, a cap bottom wall, and a cap sealing ring defined on the cap bottom surface extending about a peripheral edge thereof, the cap fitted into the socket and being movable between a storage position, an opening position, a drinking position, wherein the cap is removed from the socket, and a resealing position;

a sharp projection disposed in a center of the cap bottom wall, and the socket further includes a central score line formed in a center of the socket bottom wall, the sharp projection and the central score line are in juxtaposition;

a first drive mechanism, detachably and rotatably connecting the cap to the socket controlling vertical displacement between the cap and the socket, and being operable by rotation of the cap to fracture the score line initiating separation of the tear panel from the socket bottom wall; and a second linear drive mechanism in sliding engagement between the cap and the socket, and being operable by rotation of the cap to increase the linear motion of the cap into the socket and thereby increase the force imparted by the first linear drive- and force the tear panel into the interior space of the body.

12. The beverage container of claim 11, wherein the first linear drive mechanism includes at least one groove formed in the cap cylindrical sidewall, and at least one projection formed in the socket cylindrical sidewall, wherein the projection is slideably located within the groove.

13. The beverage container of 11, the cap second linear drive mechanism element is a first series of ramps, and the mating socket second linear drive mechanism element is a second series of ramps, wherein each ramp of the first series of ramps and each associated ramp of the second series of ramps are in sliding engagement with one another.

14. The beverage container of claim 12, the cap further comprising an outer piercing element, wherein the outer piercing element is in registration with the score line.

15. A method of making and using a resealable can lid, comprising:

forming a lid from a substantially planar blank;

forming a socket in the blank, the socket having a socket sidewall, a socket bottom wall, projections extending towards a center of the socket from the socket sidewall and socket ramps integral with the socket bottom wall;

forming a score line in the socket bottom wall, the score line defining a tear panel, wherein the score line is located inward from the cylindrical sidewall, defining an annular surface between the score line and the cylindrical sidewall providing a socket seating arrangement segment, and whose start and end do not meet to define a hinge for the tear panel;

forming a cap having a cap sidewall, a cap bottom wall, at least one cam groove formed in the cap sidewall, a cap sealing ring defined on the cap bottom surface extending about a peripheral edge thereof, a piercing element extending downward from the cap bottom surface wherein the piercing element is located in alignment with the score line when the cap is inserted into the socket, cap ramps integral with the cap bottom wall and located within an interior of the cap sealing ring;

inserting the cap into the socket locating each projection of the at least one projection to slideably engage with each associated cam groove of the at least one cam groove; and locating each socket ramps of the socket ramps and each mating cap ramp of the cap ramps in contact with one another, wherein when the cap is rotated within the socket in a first direction, each at least one projection cooperatively engages with the respective cam groove enabling the piercing element to initiate a fracture of the score line and the tear panel to initiate separation from the socket bottom wall, and each cap bottom ramp of said at least one cap bottom ramp and the mating at least one socket bottom wall ramp to cooperatively engage with one another to generate and apply an opening force to the tear panel causing the score line fracture to propagate and subsequently cause the tear panel to fold away from the socket bottom wall, wherein the cap is rotated in second direction and removed from the socket, and wherein the cap is reinserted into the socket and rotated in the first direction seating the cap sealing ring against the socket seating arrangement segment to seal the lid.

16. A method according to claim 15, further comprising forming a puncture element in a center of the cap bottom wall, and a central score line in a center of the socket bottom wall, and juxtaposing the puncture element and the central score line when the cap is inserted into the socket.

17. A method of making a resealable can lid, comprising:

forming a lid from a substantially planar blank;

forming a socket in the blank, the socket having a socket sidewall, a socket bottom wall, a socket sidewall drive mechanism component integral with the socket sidewall, and a socket bottom wall drive mechanism component integral with the socket bottom wall;

forming a score line in the bottom wall of the socket, the score line defining a tear panel, wherein the score line is located inward from the cylindrical sidewall and external of the socket bottom wall drive mechanism component, defining an annular surface between the score line and the cylindrical sidewall providing a socket seating arrangement segment;

forming a cap having a cap sidewall, a cap bottom wall, a cap sidewall drive mechanism component integral with the cap sidewall, a cap bottom wall drive mechanism component integral with the cap bottom wall and located within an interior of the cap sealing ring;

forming a piercing element integral with the cap bottom wall, located within an interior of the cap sealing ring;

inserting the cap into the socket locating the socket sidewall drive mechanism to slideably engage with the cap sidewall drive mechanism component; and locating the socket bottom wall drive mechanism component and the cap bottom wall drive mechanism component in contact with one another, and locating the piercing element in registration with the score line, wherein when the cap is rotated within the socket in a first direction, the socket sidewall drive mechanism engages with the cap sidewall drive mechanism component, driving the cap bottom surface towards the socket bottom wall, creating an opening force applied by the piercing element onto the score line causing the score line to fracture and the tear panel to partially separate from the socket bottom wall;

wherein as the cap continues to rotate within the socket in the first direction, the socket bottom wall drive mechanism and the cap bottom wall drive mechanism component to cooperatively engage with one another to generate and apply secondary opening force to the tear panel causing the score line fracture to propagate and the tear panel to continue to separate from the socket bottom wall, and bend to separated section of the tear panel away from the socket bottom wall, wherein the cap is rotated in second direction and removed from the socket, and wherein when the cap is reinserted into the socket and rotated in the first direction, the cap sealing ring is seated against the socket seating arrangement segment, sealing the resealable lid.

18. A method according to claim 17, further comprising forming a puncture element in a center of the bottom wall of the cap, and a second score line in a center of the bottom wall of the socket, and juxtaposing the puncture element and the second score line when the cap is inserted into the socket.

19. A method according to claim 17, wherein at least one of the socket bottom wall drive mechanism and the cap bottom wall drive mechanism component is provided in a shape of a ramp.

20. A beverage container comprising:

a body having a bottom wall and a side wall which defines an open lid;

a lid fitted into and sealingly engaging the open lid, and having a socket;

the socket comprising a socket cylindrical sidewall extending downward from a planar section of the lid, a socket bottom wall sealingly extending across a lower end of the socket cylindrical sidewall, a socket bottom wall drive mechanism component integral with the socket bottom wall, and a score line in the socket bottom wall, wherein the score line is substantially S shaped;

a cap comprising a cap cylindrical sidewall, a cap bottom wall, and a cap bottom wall drive mechanism component integral with the cap bottom wall, the cap fitted into the socket and being movable between pre-opened, opening, and resealing positions; and wherein when the cap is rotated within the socket, the socket bottom wall drive mechanism component and the cap bottom wall drive mechanism component work cooperatively with one another to generate a force imparted upon the socket bottom wall to fracture the score line.

21. A beverage container comprising:

a container body having:

a sidewall defining a tubular section extending between a top edge and a bottom end, a bottom wall providing a seal across the sidewall bottom end, and an opening defined by the sidewall top edge;

a lid for the beverage container, comprising:

a substantially planar surface having a peripheral edge;

a socket comprising a socket cylindrical sidewall extending downward from the substantially planar surface, a socket bottom wall sealingly extending across a lower end of the socket cylindrical sidewall, a socket sidewall drive mechanism component integral with the socket sidewall, a score line disposed in the bottom wall of the socket and defining a tear panel, wherein the score line is located inward from the cylindrical sidewall, defining an annular surface between the score line and the cylindrical sidewall providing a socket seating arrangement segment, and a socket bottom wall drive mechanism component integral with the socket bottom wall and located within an interior of the socket seating arrangement segment;

a cap comprising a cap cylindrical sidewall, a cap bottom wall, and a cap sealing ring defined on the cap bottom surface extending about a peripheral edge thereof, a cap sidewall drive mechanism component integral with the cap bottom wall, and a cap bottom wall drive mechanism component integral with the cap bottom wall and located within an interior of the cap sealing ring, the cap fitted into the socket and being movable between a storage position, an opening position, a drinking position, wherein the cap is removed from the socket, and a resealing position abutting the cap sealing ring and the socket seating arrangement segment against one another forming a seal therebetween;

wherein the cap is rotationally inserted into the socket locating the socket sidewall drive mechanism in slideably engagement with the cap sidewall drive mechanism component and the socket bottom wall drive mechanism component and the cap bottom wall drive mechanism component are located in juxtaposition and in contact with one another, wherein when the cap is rotated within the socket in a first direction, the socket sidewall drive mechanism engages with the cap sidewall drive mechanism component, driving the cap bottom surface towards the socket bottom wall, creating an opening force applied by the piercing element onto the score line causing the score line to fracture and the tear panel to partially separate from the socket bottom wall;

wherein as the cap continues to rotate within the socket in the first direction, the socket bottom wall drive mechanism and the cap bottom wall drive mechanism component to cooperatively engage with one another to generate and apply secondary opening force to the tear panel causing the score line fracture to propagate and the tear panel to continue to separate from the socket bottom wall, and bend to separated section of the tear panel away from the socket bottom wall, wherein when the cap is rotated in second direction, the cap is removed from the socket enabling passage of a beverage from a beverage container through an orifice created by the fractured score line and opened tear panel, and wherein when the cap is reinserted into the socket and rotated in the first direction, the cap sealing ring is seated against the socket seating arrangement segment, sealing the resealable cap.

22. A beverage container according to claim 21, the cap further comprising a grip, and a cap rotation enhancing element comprising a feature for receiving an implement capable of engaging the grip, wherein said implement enhances a rotation of the cap.

23. A beverage container according to claim 22, wherein the implement is a coin inserted into a coin receiving slot.

24. A beverage container according to claim 21, wherein the score line is substantially in the shape of a loop.

25. A beverage container according to claim 21, wherein the score line is substantially S shaped.

26. The beverage container of claim 21, further comprising at least one of:

the cap drive mechanism component formed having a vertically sloping ramp, the mating socket drive mechanism component formed having a vertically sloping ramp, the socket sidewall drive mechanism component formed as a protrusion extending towards a center of the socket, and the cap sidewall drive mechanism component formed as a groove inward from the cap sidewall.

27. The beverage container of claim 21, wherein the cap drive mechanism component and the mating socket drive mechanism component each include a vertically sloping ramp.

28. The beverage container of claim 21, wherein the socket sidewall drive mechanism includes a projection formed in the socket cylindrical sidewall and the cap sidewall drive mechanism component includes a groove formed in the cap cylindrical sidewall, wherein the projection is slideably located within the groove.

29. A resealable cap for a beverage container comprising:

a lid comprising a substantially planar surface having a peripheral edge;

a socket comprising a socket cylindrical sidewall extending downward from the substantially planar surface, a socket bottom wall sealingly extending across a lower end of the socket cylindrical sidewall, a socket sidewall drive mechanism component integral with the socket sidewall, a score line disposed in the bottom wall of the socket and defining a tear panel, wherein the score line is located inward from the cylindrical sidewall, defining an annular surface between the score line and the cylindrical sidewall providing a socket seating arrangement segment, and a socket bottom wall drive mechanism component integral with the socket bottom wall and located within an interior of the socket seating arrangement segment;

a cap comprising a cap cylindrical sidewall, a cap bottom wall, and a cap sealing ring defined on the cap bottom surface extending about a peripheral edge thereof, a cap sidewall drive mechanism component integral with the cap bottom wall, and a cap bottom wall drive mechanism component integral with the cap bottom wall and located within an interior of the cap sealing ring, the cap fitted into the socket and being movable between a storage position, an opening position, a drinking position, wherein the cap is removed from the socket, and a resealing position abutting the cap sealing ring and the socket seating arrangement segment against one another forming a seal therebetween;

wherein the cap is rotationally inserted into the socket locating the socket sidewall drive mechanism in slideably engagement with the cap sidewall drive mechanism component and the socket bottom wall drive mechanism component and the cap bottom wall drive mechanism component are located in juxtaposition and in contact with one another, wherein when the cap is rotated within the socket in a first direction, the socket sidewall drive mechanism engages with the cap sidewall drive mechanism component, driving the cap bottom surface towards the socket bottom wall, creating an opening force applied by the piercing element onto the score line causing the score line to fracture and the tear panel to partially separate from the socket bottom wall;

wherein as the cap continues to rotate within the socket in the first direction, the socket bottom wall drive mechanism and the cap bottom wall drive mechanism component to cooperatively engage with one another to generate and apply secondary opening force to the tear panel causing the score line fracture to propagate and the tear panel to continue to separate from the socket bottom wall, and bend to separated section of the tear panel away from the socket bottom wall, wherein when the cap is rotated in second direction, the cap is removed from the socket enabling passage of a beverage from a beverage container through an orifice created by the fractured score line and opened tear panel, and wherein when the cap is reinserted into the socket and rotated in the first direction, the cap sealing ring is seated against the socket seating arrangement segment, sealing the resealable cap.

30. The resealable cap of claim 29, further comprising at least one of:

the cap drive mechanism component formed having a vertically sloping ramp, the mating socket drive mechanism component formed having a vertically sloping ramp, the socket sidewall drive mechanism component formed as a protrusion extending towards a center of the socket, and the cap sidewall drive mechanism component formed as a groove inward from the cap sidewall.

31. The resealable cap of claim 29, wherein the cap drive mechanism component and the mating socket drive mechanism component each include a vertically sloping ramp.

32. The resealable cap of claim 29, wherein the socket sidewall drive mechanism includes a projection formed in the socket cylindrical sidewall and the cap sidewall drive mechanism component includes a groove formed in the cap cylindrical sidewall, wherein the projection is slideably located within the groove.

33. A resealable cap for a beverage container comprising:

a lid substrate having a generally planar section bound by a peripheral edge;

a socket comprising a socket cylindrical sidewall extending downward from the generally planar section, a socket bottom wall sealingly extending across a lower end of the socket cylindrical sidewall, a socket sidewall drive mechanism component integral with the socket sidewall, a score line disposed in the bottom wall of the socket and defining a tear panel, wherein the score line is located inward from the cylindrical sidewall, defining an annular surface between the score line and the cylindrical sidewall providing a socket seating arrangement segment, and a socket bottom wall drive mechanism component integral with the socket bottom wall and located within an interior of the socket seating arrangement segment;

a cap comprising a cap cylindrical sidewall, a cap bottom wall, and a cap sealing ring defined on the cap bottom surface extending about a peripheral edge thereof, a cap sidewall drive mechanism component integral with the cap bottom wall, and a cap bottom wall drive mechanism component integral with the cap bottom wall and located within an interior of the cap sealing ring, the cap fitted into the socket and being movable between a storage position, an opening position, a drinking position, wherein the cap is removed from the socket, and a resealing position abutting the cap sealing ring and the socket seating arrangement segment against one another forming a seal therebetween;

a first drive mechanism provided by cooperative operation between the socket sidewall drive mechanism and the cap sidewall drive mechanism component, the first drive mechanism detachably and rotatably connecting the cap to the socket controlling vertical displacement between the cap and the socket, and being operable by rotation of the cap, driving the cap bottom surface towards the socket bottom wall, creating an opening force applied by the piercing element onto the score line causing the score line to fracture and the tear panel to partially separate from the socket bottom wall; and a second linear drive mechanism provided by cooperative interaction between the socket bottom wall drive mechanism component and the cap bottom wall drive mechanism component, the second linear drive mechanism cooperative interaction operating in conjunction with the cooperative operation of the first drive mechanism, to apply a force provided by a combination of the first drive mechanism and the second linear drive mechanism causing the fracture of the score line to propagate and displace a portion of the tear panel away from the socket bottom wall creating an orifice between the tear panel and the socket bottom wall.

34. The resealable cap of claim 33, further comprising at least one of:

the cap drive mechanism component formed having a vertically sloping ramp, the mating socket drive mechanism component formed having a vertically sloping ramp, the socket sidewall drive mechanism component formed as a protrusion extending towards a center of the socket, and the cap sidewall drive mechanism component formed as a groove inward from the cap sidewall.

* * * * *